US010837394B2

(12) United States Patent
Sanada

(10) Patent No.: US 10,837,394 B2
(45) Date of Patent: Nov. 17, 2020

(54) FUEL INJECTION CONTROLLER

(71) Applicant: DENSO CORPORATION, Kariya (JP)

(72) Inventor: Kei Sanada, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/780,061

(22) Filed: Feb. 3, 2020

(65) Prior Publication Data

US 2020/0248643 A1 Aug. 6, 2020

(30) Foreign Application Priority Data

Feb. 5, 2019 (JP) ..... 2019-018861

(51) Int. Cl.
*F02D 41/20* (2006.01)
*F02D 41/38* (2006.01)
*F02D 41/40* (2006.01)

(52) U.S. Cl.
CPC ..... *F02D 41/3863* (2013.01); *F02D 41/401* (2013.01); *F02D 2041/2013* (2013.01); *F02D 2041/2051* (2013.01)

(58) Field of Classification Search
CPC ..... F02D 41/3863; F02D 41/401; F02D 2041/2013; F02D 2041/2051
USPC ..... 701/104, 105; 123/472, 478, 490; 361/154
See application file for complete search history.

(56) References Cited

U.S. PATENT DOCUMENTS 4,338,651 A * 7/1982 Henrich ..... H01F 7/1827 123/490
6,005,763 A * 12/1999 North ..... F02D 41/20 123/490
7,546,830 B2 * 6/2009 Nagase ..... B60K 6/48 123/490
8,725,392 B2 * 5/2014 Bolz ..... F02D 41/20 701/113
10,280,864 B2 * 5/2019 Yanoto ..... F01L 9/04
2010/0242920 A1 * 9/2010 Omori ..... F02D 41/221 123/490

FOREIGN PATENT DOCUMENTS

DE 102013112751 A1 5/2015
WO 2019/039480 A1 2/2019

* cited by examiner

*Primary Examiner* — Erick R Solis
(74) *Attorney, Agent, or Firm* — Posz Law Group, PLC

(57) ABSTRACT

A fuel injection controller includes a discharge switch that turns ON/OFF energization of a first energization path from a boost power source of a second booster circuit when a second control IC energizes a second solenoid, a first detection element that detects a value that depends on an energization state of the discharge switch, a constant current switch that turns ON/OFF energization of a second energization path from a power source voltage that outputs a lower voltage than a boost power source voltage when the second control IC energizes the second solenoid, a second element that detects a value that depends on an energization state of the constant current switch, and an energization path controller that switches energization to the second solenoid.

6 Claims, 12 Drawing Sheets

51
MICOM
53
2ND CONT IC
55
2ND BOOSTER
VB
Vboost2
58
VB
81
82
83
84
85
87
88
89
90
91
92
93
94
95
ENRGZ PATH CONT
2a
2b
2c
32(#1)
32(#4)

FUEL INJECTION CONTROLLER

CROSS REFERENCE TO RELATED APPLICATION

The present application is based on and claims the benefit of priority of Japanese Patent Application No. 2019-018861, filed on Feb. 5, 2019, the disclosure of which is incorporated herein by reference.

TECHNICAL FIELD

The present disclosure generally relates to a fuel injection controller.

BACKGROUND INFORMATION

The related art includes a fuel injector that injects fuel from a tip of the nozzle by controlling hydraulic pressure using two solenoid valves. The injector of the related art is configured such that fuel can be injected from a nozzle at the tip of the injector by utilizing an actuator that uses a piezo stack.

When the fuel injection controller performs fuel injection control, the fuel injection control is performed on the fuel injected to the internal combustion engine from the common rail in which the fuel is stored. When such a fuel injection controller performs fuel injection control using two solenoid valves (hereinafter referred to as a first valve and a second valve, respectively) in a fuel injector (also referred to as an injector), the fuel injection controller is configured to control an injection rate of the fuel by driving the second valve via energization of a second solenoid while controlling an injection timing of the fuel by driving the first valve via energization of a first solenoid.

When the fuel injection valve is opened while controlling the injection rate, the solenoid-type fuel injection controller supplies energy to the second solenoid by turning ON/OFF an electric current from a boost power source by the first switch, and then supplies energy to the second solenoid by turning ON/OFF the electric current from a battery power source by the second switch.

In such a case, it has been found that heat stress generated in the first and second switches provided on the energization path to the second solenoid tends to increase. Note that, in the description above and in the following, a term energization means a supply of electric power, electric current, or an application of voltage.

SUMMARY

It is an object of the present disclosure is to provide a fuel injection controller capable of energizing a second solenoid without imposing heat stress to the first and second switches as much as possible.

BRIEF DESCRIPTION OF THE DRAWINGS

Objects, features, and advantages of the present disclosure will become more apparent from the following detailed description made with reference to the accompanying drawings, in which.

DETAILED DESCRIPTION

Figure 1:
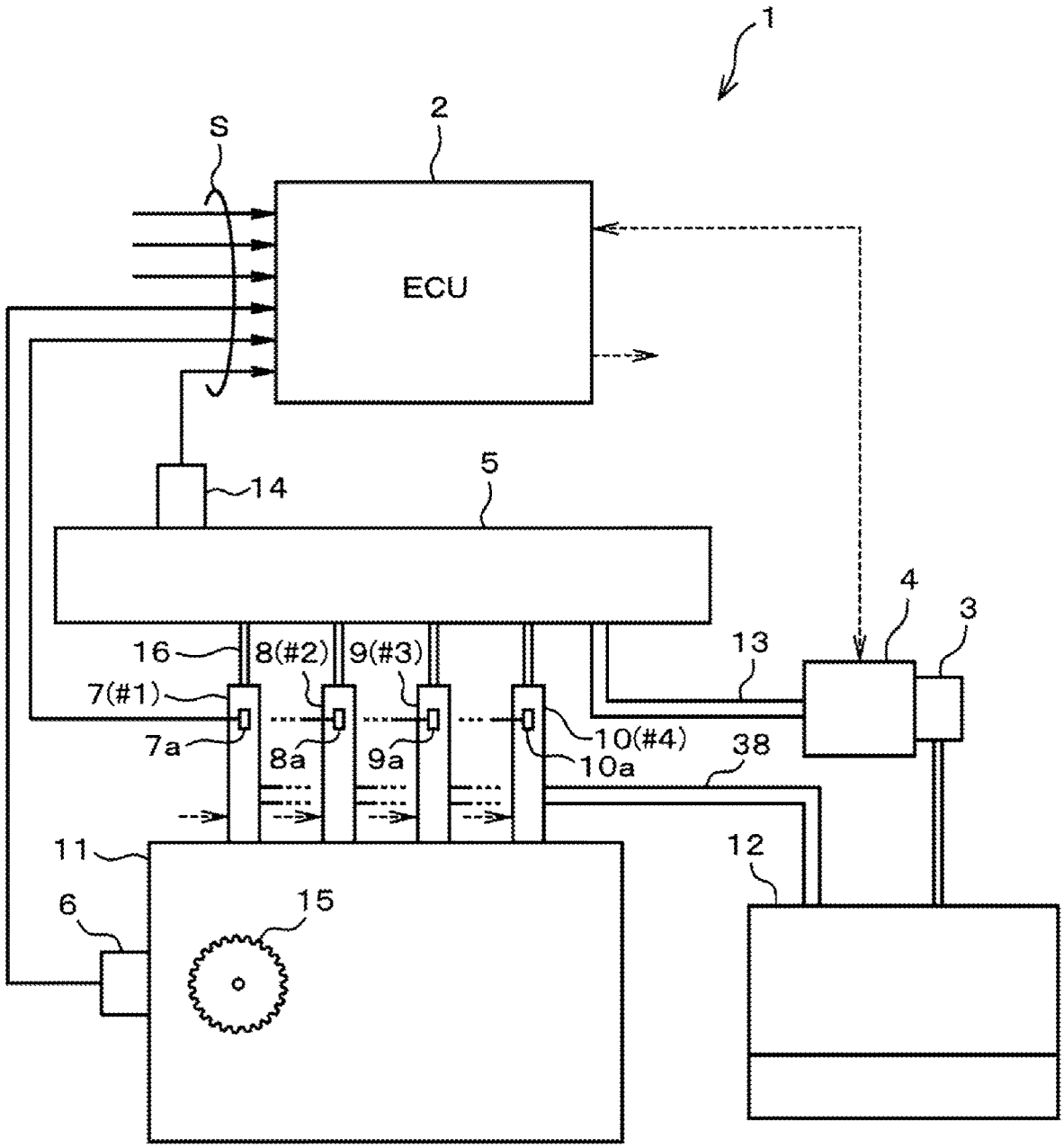
FIG. 1 is a configuration diagram of a fuel injection control system according to a first embodiment.

Hereinafter, several embodiments of a fuel injection controller are described with reference to the drawings. In each of the embodiments, configurations that perform the same or similar operations are denoted by the same or similar reference numerals, and description thereof is omitted as necessary.

First Embodiment

FIG. 1 to FIG. 10 show explanatory diagrams of the first embodiment. First, the configuration of a fuel injection control system 1 is described with reference to FIG. 1. The fuel injection control system 1 includes, as its primary components, a fuel injection controller (hereinafter referred to as a controller) 2 implemented as an ECU (Electronic Control Unit), a feed pump 3, a high-pressure fuel pump 4, a common rail 5, a crank angle sensor 6, fuel injectors 7 to 10 and an internal combustion engine 11.

The controller 2 controls the supply of fuel to combustion chambers of cylinders #1 to #4 of the internal combustion engine 11 by individually controlling the fuel injectors 7 to 10. In the present embodiment, an example in which the internal combustion engine 11 has four cylinders is shown, but the engine 11 may have six cylinders, and the present disclosure is not limited to such numbers. Of the four cylinders, two cylinders #1 and #4 are referred to as a first bank, and two cylinders #2 and #3 are referred to as a second bank.

The feed pump 3 pumps the fuel stored in the fuel tank 12 to the high-pressure fuel pump 4. The high-pressure fuel pump 4 is, for example, a plunger type pump. The high-pressure fuel pump 4 is driven by a pump driver 60 (described later) of the controller 2 using an output shaft of the internal combustion engine 11. The high-pressure fuel pump 4 boosts a low-pressure fuel supplied from the feed pump 3 to produce a high-pressure fuel, and supplies the high-pressure fuel to the common rail 5 through a high-pressure fuel pipe 13. The common rail 5 is provided for supplying fuel to the fuel injectors 7 to 10. The common rail 5 temporarily accumulates the high-pressure fuel supplied from the high-pressure fuel pump 4, and distributes the high-pressure fuel to the fuel injectors 7 to 10 through a high-pressure pipe 16 while maintaining the high pressure.

The common rail 5 is provided with a pressure sensor 14. The pressure sensor 14 detects a pressure of the fuel accumulated in the common rail 5, and outputs a detection signal to the controller 2. The crank angle sensor 6 is combined with a signal rotor 15 in configuration, and detects rotation of a crankshaft (not shown) inside the internal combustion engine 11. The signal rotor 15 is configured, for example, to have a disk shape, and rotates integrally with, for example, the crankshaft of the internal combustion engine 11. A large number of protrusions are formed on the outer periphery of the signal rotor 15, and the crank angle sensor 6 outputs a crank angle signal corresponding to the approach and departure of the protrusions of the signal rotor 15.

The controller 2 can calculate an engine rotation number in response to receiving a crank angle signal from the crank angle sensor 6. The controller 2 changes and controls a torque for rotating the crankshaft with the change of a sensor signal S. The controller 2 controls fuel injection through the fuel injectors 7 to 10 based on various sensor signals S including the crank angle signal.

<Basic Configuration and Operation Explanation of Fuel Injectors 7 to 10>

The basic configuration and operation of the fuel injectors 7 to 10 are described below. The fuel injectors 7 to 10 are provided for injecting fuel into the cylinders of the internal combustion engine 11, and may also be referred to as injectors or fuel injection valves.

The fuel injectors 7 to 10 are provided with built-in pressure sensors 7*a* to 10*a*, respectively. The fuel injectors 7 to 10 all have the same structure. Therefore, hereinafter, the structure of the fuel injector 7 is described with reference to FIG. 2, and the description of the structure of the fuel injectors 8 to 10 is omitted.

Figure 2:
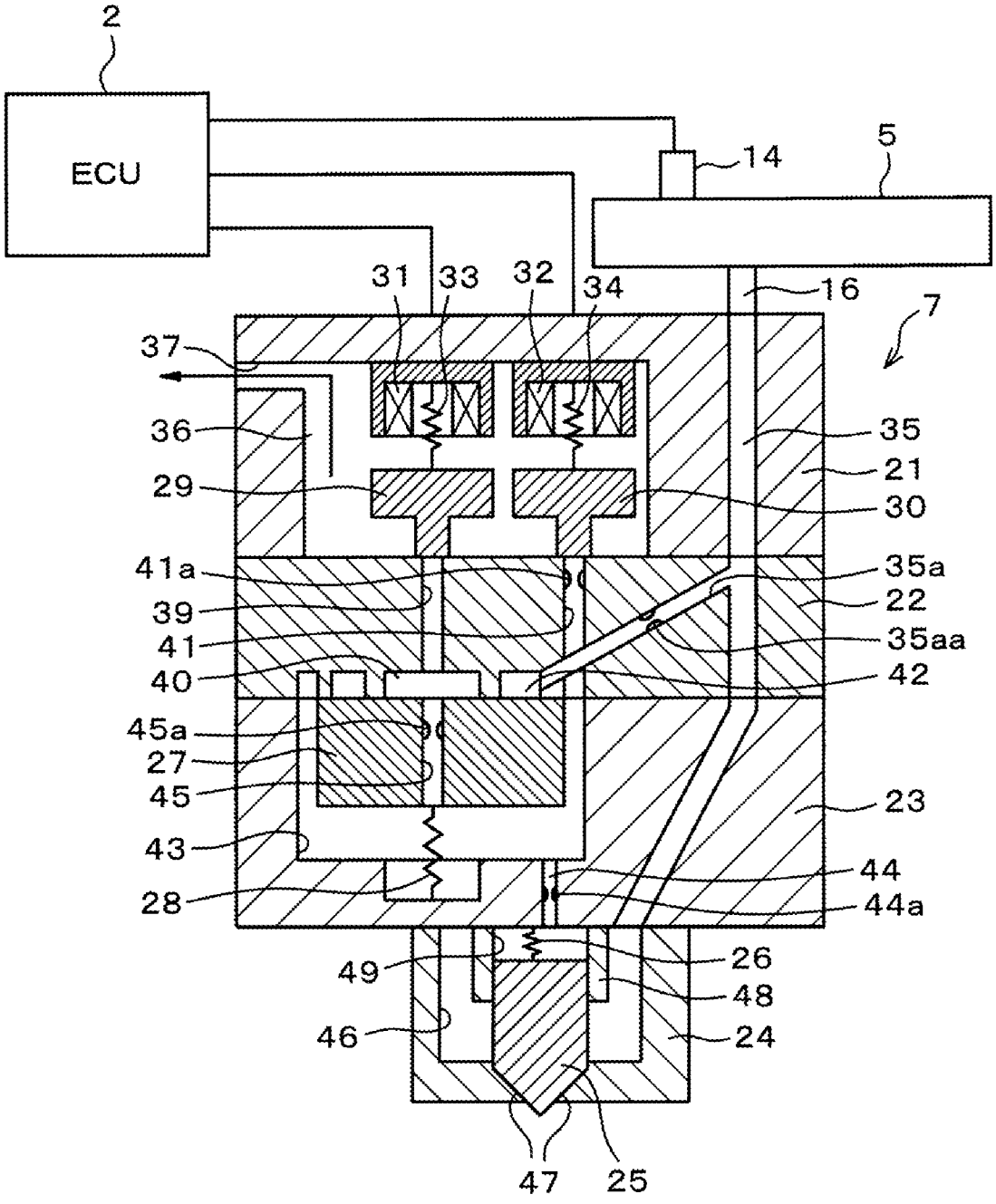
FIG. 2 is a sectional view illustrating a fuel injector.

As shown in FIG. 2, the fuel injector 7 includes a first member 21, a second member 22, a third member 23, a fourth member 24, a nozzle needle 25, a spring 26 for the nozzle needle 25, a hydraulic driven valve 27, a spring 28 for the hydraulic driven valve 27, a first valve 29, a second valve 30, a first solenoid 31, a second solenoid 32, a first spring 33, a second spring 34, and the like as its main components.

The first member 21 includes a first high-pressure fuel passage 35, a low pressure chamber 36, and a low pressure passage 37. When the first member 21, the second member 22, and the third member 23 are assembled, the first high-pressure fuel passage 35 is configured to penetrate through the first to third members 21 to 23. The first high-pressure fuel passage 35 is connected to the common rail 5 through the high-pressure pipe 16, and high-pressure fuel is supplied from the common rail 5 through the high-pressure pipe 16.

The low-pressure chamber 36 provided in the first member 21 is configured to communicate with a third passage 39 through an opening on a second member 22 side of the chamber 36 when the first valve 29 is opened, and when the first valve 29 is closed, the third passage 39 is configured to be blocked or interrupted. Further, the low-pressure chamber 36 is configured to communicate with a second passage 41, i.e., an opening on a second member 22 side when the second valve 30 is opened, and when the second valve 30 is closed, the second passage 41 is configured to be blocked.

In the low-pressure chamber 36, the periphery of the opening on the second member 22 side between the first member 21 and the second member 22 is sealed. Further, the low-pressure chamber 36 is configured to communicate with the low-pressure passage 37. A low-pressure pipe 38 shown in FIG. 1 is connected to the low-pressure passage 37. The low-pressure fuel in the low-pressure chamber 36 flows out from the low-pressure chamber 36 and is returned to the fuel tank 12 via the low-pressure passage 37 and the low-pressure pipe 38.

The first valve 29, the second valve 30, the first solenoid 31, the second solenoid 32, the first spring 33, and the second spring 34 are arranged inside the low-pressure chamber 36 of the first member 21.

Usually or normally, the first spring 33 is arranged so as to bias the first valve 29 in a direction approaching the third passage 39. In such case, since the first valve 29 is closed, communication between the low-pressure chamber 36 and the third passage 39 is blocked. The second spring 34 is arranged so as to bias the second valve 30 in a direction approaching the second passage 41. In such case, since the second valve 30 is closed, communication between the low-pressure chamber 36 and the second passage 41 is blocked.

The first solenoid 31 is a device that generates an electromagnetic force when energized, and repels a biasing force of the first spring 33 to separate or lift the first valve 29 from the second member 22. Thereby, the first valve 29 can be driven to open by energizing the first solenoid 31, and the low-pressure chamber 36 and the third passage 39 can communicate with each other by the opening of the first valve 29.

The second solenoid 32 is a device that generates an electromagnetic force when energized, and repels a biasing force of the second spring 34 to separate or lift the second valve 30 from the second member 22. Thereby, the second valve 30 can be driven to open by energizing the second solenoid 32, and the low-pressure chamber 36 and the second passage 41 can communicate with each other by the opening of the second valve 30.

The second member 22 includes the third passage 39, an intermediate chamber 40, and the second passage 41, and further includes a second high-pressure fuel passage 35*a* branched from the first high-pressure fuel passage 35. The high-pressure fuel is branched and supplied from the first high-pressure fuel passage 35 to the second high-pressure fuel passage 35*a*. The second high-pressure fuel passage 35*a* includes a third orifice 35*aa* and is connected to an annular chamber 42. The third orifice 35*aa* limits a flow amount of the high-pressure fuel flowing through the second high-pressure fuel passage 35*a*. The second high-pressure fuel passage 35*a* may be provided with a plurality of third orifices 35*aa*, or the second high-pressure fuel passage 35*a* may have a small flow area so that the structure of the second high-pressure fuel passage 35*a* itself serves as the third orifice 35*aa*.

The second passage 41 includes a second orifice 41*a*, and connects the low-pressure chamber 36 and a first control chamber 43 without passing through the inside of the hydraulic driven valve 27. The second passage 41 may include a plurality of second orifices 41*a*, or the second passage 41 may have a small flow area so that the structure of the second passage 41 itself serves as the second orifice 41*a*.

The annular chamber 42 is configured in an annular shape, and is configured to communicate with the first control chamber 43 through an opening on a third member 23 side. The first control chamber 43 is configured (i.e., provided) in the third member 23. The first control chamber 43 is disposed in contact with the second member 22, and has a partial opening on a second member 22 side. The periphery of the opening between the second member 22 and the third member 23 is sealed. A connection passage 44 is connected to the first control chamber 43. The connection passage 44 is a passage between the first control chamber 43 and the second control chamber 49. The connection passage 44 includes a fourth orifice 44*a*, and the fourth orifice 44*a* restricts the flow amount of the fuel flowing through the connection passage 44. The connection passage 44 may include a plurality of fourth orifices 44*a*, or the structure of the connection passage 44 may have a small flow area so that the structure of the connection passage 44 itself serves as the fourth orifice 44*a*.

The hydraulic driven valve 27 is disposed inside the first control chamber 43. The hydraulic driven valve 27 is configured in a cylindrical shape. The cylindrical hydraulic driven valve 27 is configured such that the first passage 45 penetrates at its center along the axis direction. The first passage 45 includes a first orifice 45*a*. The first orifice 45*a* limits the flow amount of the fuel flowing through the first passage 45. The first passage 45 may include a plurality of first orifices 45*a*, or the first passage 45 may have a small flow area so that the structure of the first passage 45 itself serves as the first orifice 45*a*.

Inside the first control chamber 43, the spring 28 is disposed to bias the hydraulic driven valve 27 in a direction approaching the second member 22. When the hydraulic driven valve 27 is in contact with the second member 22, the intermediate chamber 40 communicates with the first control chamber 43 via the first passage 45 and the first orifice 45*a*, but the opening on the third member 23 side of the annular chamber 42 is blocked by the hydraulic driven valve 27.

Figure 3:
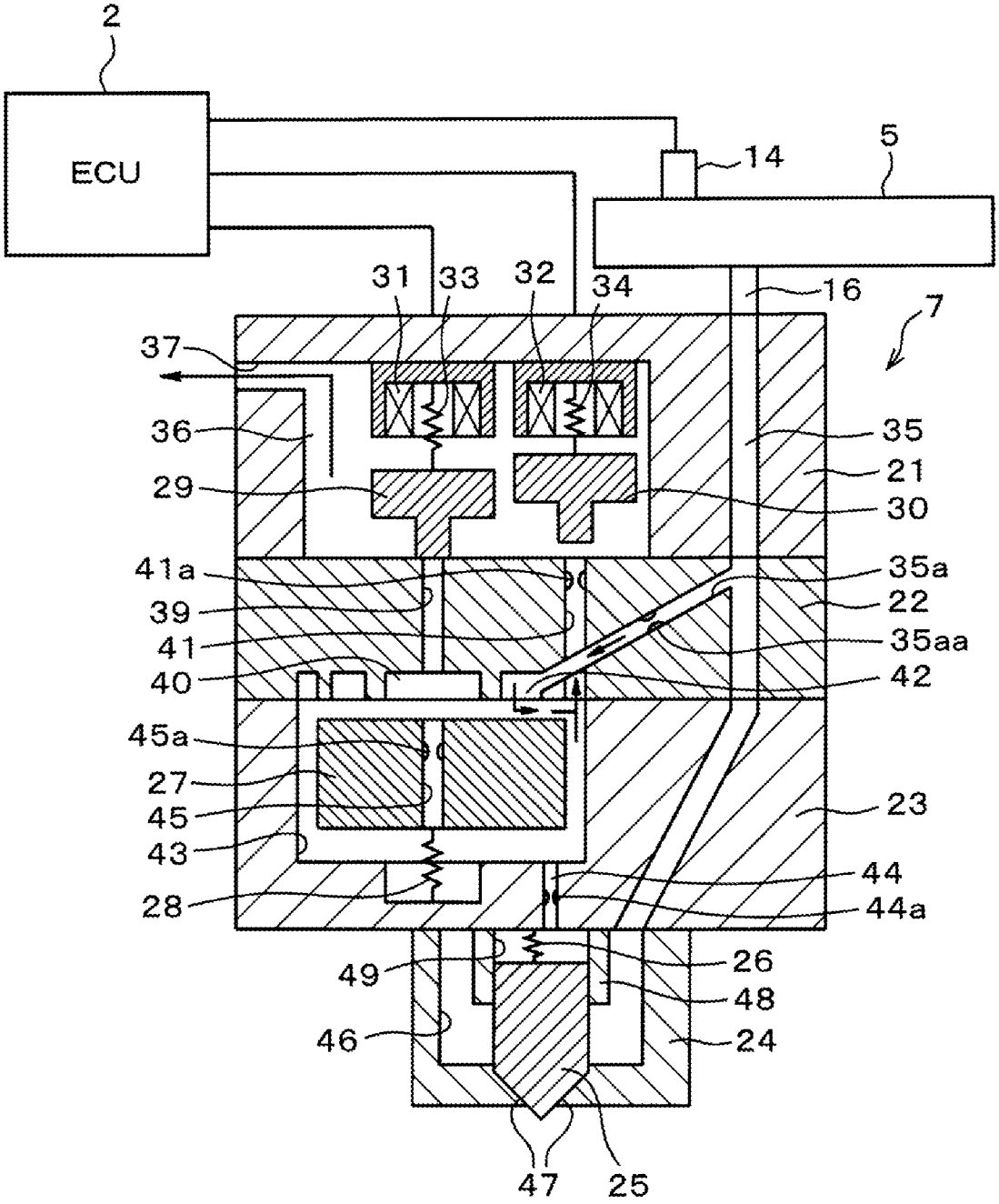
FIG. 3 is an explanatory diagram illustrating a flow of fuel to reduce internal pressure of a common rail.

For example, as shown in FIG. 3, when the hydraulic driven valve 27 is lifted from the second member 22, the intermediate chamber 40 communicates with the first control chamber 43 without passing through the first passage 45, and the annular chamber 42 also communicates with the first control chamber 43. Further, as shown in FIGS. 2 and 3, the second passage 41 is configured to communicate with the first control chamber 43 without passing through the hydraulic driven valve 27. The second passage 41 establishes a direct communication between the low-pressure chamber 36 and the first control chamber 43 regardless of the position of the hydraulic driven valve 27, that is, without regard to a lift state of the hydraulic driven valve 27.

As shown in FIG. 2, the fourth member 24 includes a high-pressure chamber 46, an injection hole 47, a cylinder 48, and the second control chamber 49. The high-pressure fuel is supplied to the high-pressure chamber 46 through the first high-pressure fuel passage 35. The nozzle needle 25 is disposed inside the fourth member 24. An end portion of the nozzle needle 25 is configured in a conical shape, a proximal end portion of the nozzle needle 25 is configured in a cylindrical shape, and the high-pressure chamber 46 surrounds the side surface of the nozzle needle 25. The cylinder 48 supports the nozzle needle 25 so as to be slidable back and forth in the vertical direction of FIG. 2. The second control chamber 49 is disposed behind, i.e., on the back of, the nozzle needle 25. The second control chamber 49 is connected to the first control chamber 43 through the connection passage 44.

The spring 26 that biases the nozzle needle 25 in an abutment direction onto the injection hole 47 is disposed inside the second control chamber 49. The first control chamber 43 and the second control chamber 49 constitute a control chamber. The injection hole 47 is configured to communicate with the inside of the cylinder of the internal combustion engine 11.

Figure 4:
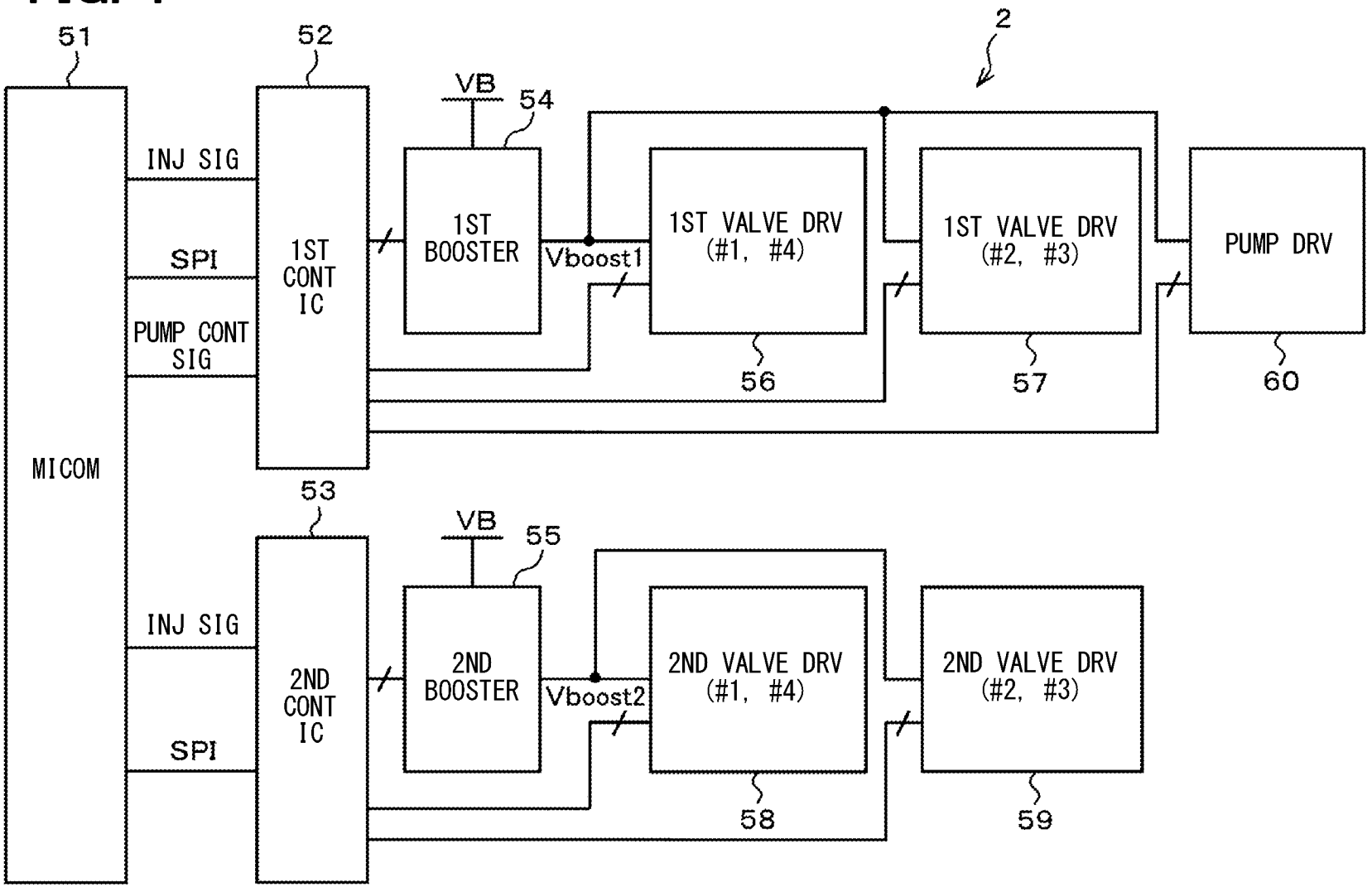
FIG. 4 is a block diagram of an electrical configuration of a fuel injection controller.

When the pressure inside the second control chamber 49 is higher than a predetermined pressure, the nozzle needle 25 keeps the high-pressure chamber 46 and the injection hole 47 blocked from each other, or the nozzle needle 25 closes the injection hole 47 by moving downward in FIG. 4. Conversely, when the pressure in the second control chamber 49 is equal to or lower than the predetermined pressure, the nozzle needle 25 moves toward the third member 23, that is, moves upward in the drawing. In such a case, the high-pressure fuel is injected via the injection hole 47 from the inside of the high-pressure chamber 46. Therefore, based on the pressure inside the first control chamber 43 and the second control chamber 49, the high-pressure chamber 46 and the cylinder of the internal combustion engine 11 can be communicated and blocked.

<Explanation of Pressure Change in Each Chamber in an Inside of Fuel Injectors 7-10>

The fuel injection control system 1 operates by setting various modes, and the controller 2 controls the injection of fuel from the injection holes 47 of the fuel injectors 7 to 10 based on these modes, and lowers the internal pressure of the common rail 5 by performing a discharge control for discharging fuel to the fuel tank 12 through the fuel injectors 7 to 10. Hereinafter, the pressure change in each chamber in an inside of the fuel injectors 7 to 10 accompanying the opening and closing operation of the first valve 29 and the second valve 30 in each mode is described.

First, a situation is assumed that, due to the biasing force of the first spring 33 and the biasing force of the second spring 34, both of the first valve 29 and the second valve 30 are closed. When the first valve 29 is closed, communication between the third passage 39 and the low-pressure chamber 36 is blocked. When the second valve 30 is closed, communication between the second passage 41 and the low-pressure chamber 36 is blocked. In such an initial state, the insides of the second control chamber 49, the first control chamber 43, the intermediate chamber 40, the third passage 39, and the second passage 41 are respectively sealed, and the fuel pressures inside each of those chambers balance in a high-pressure state. Therefore, the injection hole 47 is closed. The hydraulic driven valve 27 abuts on the second member 22 by being biased by the spring 28.

<Low Injection Rate Mode>

Hereinafter, a change in the pressure state of each chamber in the fuel injectors 7 to 10 in a low injection rate mode in which fuel is injected from the injection hole 47 into the internal combustion engine 11 relatively slowly is described. In the low injection rate mode, the controller 2 opens the first valve 29 with the second valve 30 kept closed from the initial state, and then closes the first valve 29.

When the first valve 29 is opened, the third passage 39 and the low-pressure chamber 36 communicate with each other. The low-pressure chamber 36, the intermediate chamber 40, and the first control chamber 43 communicate with each other through the third passage 39. As a result, the first control chamber 43 and the intermediate chamber 40 have a reduced pressure, and the intermediate chamber 40 also has a reduced pressure, which is substantially the same as the pressure of the low-pressure chamber 36.

Further, even though the fuel accumulated in the first control chamber 43 flows toward the intermediate chamber 40 through the first passage 45, the flow amount of the fuel through the first orifice 45*a* is limited by the effects of the first orifice 45*a*. Accordingly, the first passage 45 generates a pressure difference before and after the first orifice 45*a*. As a result, the first control chamber 43 is maintained at an intermediate pressure state.

The hydraulic driven valve 27 is attracted to an intermediate chamber 40 side of the second member 22 by the fuel pressure inside the first control chamber 43. Since the opening of the annular chamber 42 on the third member 23 side is closed by the hydraulic driven valve 27, a block state between the second high-pressure fuel passage 35*a* and the first control chamber 43 is maintained.

Since the pressure in the first control chamber 43 is in an intermediate pressure state, the pressure in the second control chamber 49 also changes to an intermediate pressure state. Then, the high-pressure fuel acts on the nozzle needle 25 through the first high-pressure fuel passage 35, and slides the nozzle needle 25 along the cylinder 48 toward the second control chamber 49. As a result, the nozzle needle 25 is opened, and high-pressure fuel is injected from the injection hole 47. At such time, since the fuel flow passage through the first orifice 45*a* is relatively limited as a narrow passage, a speed at which the first control chamber 43 reaches the intermediate pressure state is also low. As a result, a vale opening speed at which the nozzle needle 25 opens becomes relatively low, and the change in the fuel injection amount along time, that is, the injection rate is relatively low.

Thereafter, when the first valve 29 is closed, the third passage 39, the intermediate chamber 40, the second passage 41, and the first control chamber 43 are sealed, but the fuel in the first control chamber 43 flows through the first orifice 45*a*, to flow into the intermediate chamber 40 and the third passage 39. On the other hand, since a pressure difference is generated between the annular chamber 42 and the first control chamber 43, the fuel inside the second high-pressure fuel passage 35*a* presses to repel the biasing force of the spring 28 through the annular chamber 42, to lift the hydraulic driven valve 27.

In such manner, a lift amount of the hydraulic driven valve 27 is reduced, and the high-pressure fuel flows into the first control chamber 43 and the second control chamber 49 through the annular chamber 42, and, as a result, the first control chamber 43 and the second control chamber 49 respectively have a high pressure. When the internal pressures of the first control chamber 43 and the second control chamber 49 change to a high-pressure state similar to the pressure of the first high-pressure fuel passage 35, the biasing force of the spring 28 acts, and the hydraulic driven valve 27 abuts on the second member 22. As a result, the hydraulic driven valve 27 blocks communication between the annular chamber 42 and the first control chamber 43, returning to the initial state described above.

<High Injection Rate Mode>

Hereinafter, a change in the pressure state of each chamber in the fuel injector 7 in the high injection rate mode when fuel is injected at high speed from the injection hole 47 is described. In the high injection rate mode, the controller 2 controls the first valve 29 and the second valve 30 to be opened almost simultaneously from the initial state.

When the first valve 29 and the second valve 30 are opened almost simultaneously, the third passage 39 and the low-pressure chamber 36 communicate with each other, and the second passage 41 and the low-pressure chamber 36 communicate with each other. Therefore, the low-pressure chamber 36, the intermediate chamber 40, and the first control chamber 43 communicate with each other through the third passage 39 and the second passage 41. Thereby, the first control chamber 43 and the intermediate chamber 40 respectively have a reduced pressure.

At such time, the pressure in the intermediate chamber 40 is reduced to the same level as that of the low-pressure chamber 36, which is enabled quicker than an above-described situation in which only the first valve 29 is opened. Further, even though the fuel accumulated in the first control chamber 43 flows to the intermediate chamber 40 side through the first passage 45, the flow amount of the fuel is limited due to the first orifice 45*a*. At such time, the first passage 45 generates a pressure difference before and after the first orifice 45*a*.

On the other hand, the fuel inside the first control chamber 43 flows through the second passage 41 to the low-pressure chamber 36. At such time, due to the effect of the second orifice 41*a*, the fuel flow amount through the second orifice 41*a* is also limited. The second passage 41 generates a pressure difference before and after the second orifice 41*a*. As a result, the first control chamber 43 is maintained in the intermediate pressure state.

At such time, the hydraulic driven valve 27 is attracted to the intermediate chamber 40 side of the second member 22 by the fuel pressure inside the first control chamber 43. Since the opening of the annular chamber 42 on the third member 23 side is closed by the hydraulic driven valve 27, the block state between the second high-pressure fuel passage 35*a* and the first control chamber 43 is maintained.

When the first control chamber 43 is in the intermediate pressure state, the pressure in the second control chamber 49 also changes to the intermediate pressure state. Since the first control chamber 43 and the second control chamber 49 are both in the intermediate pressure state, when high-pressure fuel acts on the nozzle needle 25 through the first high-pressure fuel passage 35, the nozzle needle 25 slidably moves along the cylinder 48 toward the second control chamber 49 as described above. As a result, the nozzle needle 25 is opened, and high-pressure fuel is injected from the injection hole 47. At such time, the fuel flow passage through the first orifice 45*a* and the second orifice 41*a* is restricted, i.e., is controlled to be wider as compared with the low injection rate mode described above, thereby a speed at which the first control chamber 43 reaches the intermediate pressure state is higher than the low injection rate mode. As a result, a valve opening speed at which the nozzle needle 25 opens the injection hole 47 becomes relatively high, and the change in the fuel injection amount along time, that is, the injection rate becomes relatively high.

Thereafter, even if the second valve 30 is closed, the internal hydraulic pressure in each chamber such as the first control chamber 43 is not substantially changed, but then, the internal fuel in the first control chamber 43 flows into the intermediate chamber 40 and the third passage 39 through the first orifice 45*a*, due to the closure of the first valve 29. At such time, the third passage 39, the intermediate chamber 40, the second passage 41, and the first control chamber 43 are sealed, and the intermediate chamber 40 and the first control chamber 43 are respectively put in the intermediate pressure state.

Since a pressure difference is generated between the annular chamber 42 and the first control chamber 43, the fuel in the second high-pressure fuel passage 35*a* presses to repel the biasing force of the spring 28 through the annular chamber 42, to lift the hydraulic driven valve 27. In such manner, a lift amount of the hydraulic driven valve 27 is reduced, and the high-pressure fuel flows into the first control chamber 43 and the second control chamber 49 through the annular chamber 42, and, as a result, the first control chamber 43 and the second control chamber 49 respectively have a high pressure. When the internal pressures of the first control chamber 43 and the second control chamber 49 changes to a high-pressure state similar to the pressure of the first high-pressure fuel passage 35, the biasing force of the spring 28 acts and the hydraulic driven valve 27 abuts on the second member 22. As a result, the hydraulic driven valve 27 blocks communication between the annular chamber 42 and the first control chamber 43, returning to the initial state described above.

<Difference in Lift Speed of the Nozzle Needle 25 Based on Open/Close State of the Second Valve 30>

When the first valve 29 and the second valve 30 are opened approximately at the same time, the internal pressure of the first control chamber 43 decreases more quickly than when only the first valve 29 is opened. Therefore, when the first valve 29 and the second valve 30 are opened approximately at the same time, the lift speed of the nozzle needle 25 is higher than when only the first valve 29 is opened. Therefore, when the first valve 29 and the second valve 30 open at the same time, the injection rate can be made higher compared with a case where only the first valve 29 is opened.

<Boot Injection Mode>

Hereinafter, the pressure change of each chamber of the fuel injector 7 in a boot injection mode is described. In the boot injection mode, the fuel injectors 7 to 10 increase the injection rate stepwise, and inject fuel from the injection hole 47. In the boot injection mode, the controller 2 controls to open the second valve 30 after opening the first valve 29 from the initial state described above.

First, when the first valve 29 is opened, the third passage 39 and the low pressure chamber 36 communicate with each other. Therefore, the low pressure chamber 36, the intermediate chamber 40, and the first control chamber 43 communicate with each other through the third passage 39. Thereby, the first control chamber 43 and the intermediate chamber 40 are reduced in pressure. At such time, the intermediate chamber 40 is reduced in pressure to the same level as the low pressure chamber 36. Although the fuel accumulated in the first control chamber 43 flows to the intermediate chamber 40 through the first passage 45, the first orifice 45*a* acts on the fuel, so that the flow rate of the fuel through the first orifice 45*a* is limited. At such time, the first passage 45 generates a pressure difference before and after the first orifice 45*a*, and the first control chamber 43 is maintained in the intermediate pressure state. The hydraulic driven valve 27 is attracted to the intermediate member 40 side of the second member 22 by the action of the fuel pressure inside the first control chamber 43. Since the opening of the annular chamber 42 on the side of the third member 23 is closed by the hydraulic driven valve 27, the block state between the second high-pressure fuel passage 35*a* and the first control chamber 43 is maintained.

Then, as described above, the high-pressure fuel acts on the nozzle needle 25 through the first high-pressure fuel passage 35, and slides the nozzle needle 25 along the cylinder 48 toward the second control chamber 49. As a result, the injection hole 47 is opened and high-pressure fuel is injected from the injection hole 47. At such time, since the flow passage of the fuel through the first orifice 45*a* is relatively narrowly limited, the speed at which the pressure in the first control chamber 43 is reduced also lowers. As a result, the valve opening speed of the nozzle needle 25 becomes relatively low, and in an initial period of the boot injection mode, the change in the fuel injection amount along time, that is, the injection rate becomes relatively low. Thereafter, when the second valve 30 is opened, the fuel in the first control chamber 43 flows to the low-pressure chamber 36 also through the second passage 41. At such time, the second orifice 41*a* acts to limit the fuel flow rate through the second orifice 41*a*. At such time, the second passage 41 generates a pressure difference before and after the second orifice 41*a*.

Since the fuel flow passage through the first orifice 45*a* and the second orifice 41*a* becomes wider than the one in the initial period of the boot injection mode, the speed at which the pressure of the first control chamber 43 is lowered and reaches the intermediate pressure state also increases. As a result, the valve opening speed of the nozzle needle 25 becomes relatively high, and the change in the fuel injection amount along time, that is, the injection rate becomes relatively high.

Thereafter, even if the second valve 30 is closed, the internal hydraulic pressure in each chamber such as the first control chamber 43 is not substantially changed, but then, the internal fuel in the first control chamber 43 flows into the intermediate chamber 40 and the third passage 39 through the first orifice 45*a* due to the closure of the first valve 29. Then, the third passage 39, the intermediate chamber 40, the second passage 41, and the first control chamber 43 are sealed, and the intermediate chamber 40 and the first control chamber 43 are put in the intermediate pressure state.

Since a pressure difference is generated between the annular chamber 42 and the first control chamber 43, the hydraulic driven valve 27 is pressed by the fuel in the second high-pressure fuel passage 35*a* to repel the biasing force of the spring 28 through the annular chamber 42. As a result, the lift amount of the hydraulic driven valve 27 is reduced, and the high-pressure fuel flows into the first control chamber 43 and the second control chamber 49 through the annular chamber 42, thereby the pressure of the first control chamber 43 and the second control chamber 49 is raised. When the internal pressures of the first control chamber 43 and the second control chamber 49 change to a high pressure state similar to the pressure of the first high-pressure fuel passage 35, the biasing force of the spring 28 acts on the hydraulic driven valve 27 to abut the valve 27 to the second member 22. As a result, the hydraulic driven valve 27 blocks communication between the annular chamber 42 and the first control chamber 43, returning to the initial state described above.

<Rail Decompression Mode>

Hereinafter, a rail decompression mode is described with reference to FIG. 3. In order to reduce the internal pressure of the common rail 5, a rail decompression mode is provided. In the rail decompression mode, the controller 2 controls, i.e., opens, the second valve 30 by the second solenoid 32 while maintaining, from the initial state, the first valve 29 in a closed state by the first solenoid 31.

As described above, in the initial state, the hydraulic driven valve 27 is biased by the spring 28, and the hydraulic driven valve 27 is in contact with the second member 22. When the second valve 30 is opened in such a state, the accumulated fuel in the first control chamber 43 is discharged to the low-pressure chamber 36 through the second passage 41, and the internal pressure of the first control chamber 43 lowers.

The accumulated fuel in the second high-pressure fuel passage 35*a* presses the hydraulic driven valve 27 through the annular chamber 42, and the hydraulic driven valve 27 is lifted from the second member 22 and the lift amount decreases thereafter. Then, the first control chamber 43 and the intermediate chamber 40 communicate with each other. Since the pressure in the intermediate chamber 40 becomes the same level as the pressure in the first control chamber 43, the hydraulic driven valve 27 is not attracted to the intermediate chamber 40 by receiving fuel pressure from the second high-pressure fuel passage 35*a*. Therefore, the fuel flows from the common rail 5 to the low-pressure chamber 36 through the first high-pressure fuel passage 35, the second high-pressure fuel passage 35*a*, the first control chamber 43, and the second passage 41, and the fuel is discharged from the low-pressure chamber 36 through the low-pressure pipe 38 into the fuel tank 12. See fuel flow indicated by arrows in FIG. 3.

Further, the fuel flow rate flowing into the first control chamber 43 via the third orifice 35*aa* of the second high-pressure fuel passage 35*a* is set to be greater than the fuel flow rate flowing into the low-pressure chamber 36 via the second orifice 41*a* of the second passage 41. Therefore, the amount of fuel flowing into the first control chamber 43 from the second high-pressure fuel passage 35*a* is greater than the amount of fuel discharged from the first control chamber 43.

As a result, the fuel pressure in the first control chamber 43 and the second control chamber 49 does not lower, and the nozzle needle 25 does not slide along the cylinder 48. Thereby, the block state in which the high pressure chamber 46 and the injection hole 47 are blocked from each other by the nozzle needle 25 can be maintained. As a result, the fuel can be discharged from the low-pressure chamber 36 without injecting the fuel into the internal combustion engine 11 from the injection hole 47, and the internal pressure of the common rail 5 can be reduced.

In summary, the controller 2 controls the opening of (i.e., opens) the second valve 30 by the second solenoid 32 to drive the hydraulic driven valve 27 to establish communication through the second orifice 41*a* and communication from the common rail 5 to the high-pressure fuel passages 35, 35*a*, to the first control chamber 43 and to the low-pressure chamber 36, thereby lowers the internal pressure of the common rail 5 by discharging the fuel from the low-pressure chamber 36, without injecting the fuel into the internal combustion engine 11 from the injection hole 47 of the nozzle needle 25.

As described above, the controller 2 can reduce the internal pressure of the common rail 5 using at least one fuel injector (for example, 7) in the rail decompression mode. A mode in which the process operation of the rail decompression mode is performed using all the fuel injectors 7 to 10 is referred to as a full decompression mode. In the full decompression mode, the internal pressure of the common rail 5 can be quickly reduced using all the fuel injectors 7 to 10.

<Electrical Configuration of the Controller 2>

Next, the electrical configuration of the controller 2 constituting the circuits involving injector drive, i.e., for the drive of the fuel injectors 7 to 10, is described. The controller 2 operates by receiving a power source voltage VB is supplied from the battery power source. Here, a specific example in which the power source voltage VB by the battery power source is a 12V system is shown, but it may be a 24V system and can be changed as appropriate. As shown in FIG. 4, the controller 2 includes a microcontroller (hereinafter referred to as a microcomputer) 51, a first control IC 52, a second control IC 53, a first booster circuit 54, a second booster circuit 55, and first valve drivers 56, 57, second valve drivers 58, 59, and a pump driver 60. The first control IC 52 corresponds to a first controller, and the second control IC 53 corresponds to a second controller.

The first valve driver 56 is provided for driving the first valve 29 of the fuel injectors 7 and 10 corresponding to the cylinders #1 and #4 of the first bank, and the first valve driver 57 is provided for driving the first valve 29 of the fuel injectors 8 and 9 corresponding to the cylinders #2 and #3 in the second bank. The second valve driver 58 is provided for driving the second valve 30 of the fuel injectors 7 and 10 corresponding to the cylinders #1 and #4 of the first bank, and the second valve driver 59 is provided for driving the second valves 30 of the fuel injectors 8 and 9 corresponding to the cylinders #2 and #3 in the second bank.

The microcomputer 51 is composed of, for example, an internal memory (not shown) such as a RAM and a ROM together with a CPU, and executes various controls by executing programs stored in the internal memory. The microcomputer 51 outputs an injection signal based on an injection start instruction and an injection stop instruction to the first control IC 52 and the second control IC 53.

The microcomputer 51 can communicate with the first control IC 52 and the second control IC 53 using serial communication lines. The microcomputer 51 can change various setting values set in each of the memories of the first control IC 52 and the second control IC 53, whereby the microcomputer 51 performs overall control of the first control IC 52 and the second control IC 53. The setting values include peak currents Ip and Ip2 that are the maximum current values, respectively, constant currents Ipb and Ipb2 that are current values of a constant current (see FIG. 8), and their durations (i.e., a continuation period of such electric current). In order to highly reliably open the valve, a pickup current may be utilized (i.e., stably supplied or held unchanged) temporarily between a peak current Ip and a constant current Ipb, but use of such a pickup current is not mentioned in the present embodiment. The microcomputer 51 outputs a pump control signal to the first control IC 52 using a dedicated line. The pump control signal is a control signal for controlling the high-pressure fuel pump 4.

Both of the first control IC 52 and the second control IC 53 may be an integrated circuit devices available as ASIC, for example. The first control IC 52 and the second control IC 53 include a logic circuit and a CPU as controlling part together with memories such as RAM, ROM, EEPROM, and the like for example, and provide various controls based on the hardware and the software.

The first control IC 52 drives and controls the first booster circuit 54, the first valve drivers 56 and 57, and the pump driver 60. The first booster circuit 54 boosts the power source voltage VB based on a boost control signal input from the first control IC 52, and supplies a first boost voltage Vboost1 higher than the power source voltage VB to the first valve drivers 56, 57 and the pump driver 60 as a boost power source. The circuit of the first booster circuit 54 has the same configuration as that of the second booster circuit 55, but the circuit configuration of the second booster circuit 55 is described later.

The first valve driver 56 energizes and deenergizes (i.e., supplies and interrupts an electric power to) the first solenoid 31 connected to output terminals 2*a* to 2*c* of the controller 2 when driving the first valve 29 of the fuel injectors 7 and 10 corresponding to the cylinders #1 and #4 of the first bank. The first control IC 52 controls the fuel injection timing by applying an electric current to the first solenoid 31 using the first valve driver 56. Since the circuit configuration of the first valve driver 56 is based on the second valve driver 58, the circuit configuration of the first valve driver 56 will be described when the circuit configuration of the second valve driver 58 is described later.

The first valve driver 57 energizes and deenergizes (i.e., supplies and interrupts an electric power to) the first solenoid 31 connected to output terminals of the controller 2 when driving the first valve 29 of the fuel injectors 8 and 9 corresponding to the cylinders #2 and #3 of the second bank. The first control IC 52 applies an electric current to the first solenoid 31 of the first valve 29 of the fuel injectors 8 and 9 corresponding to the cylinders #2 and #3 of the second bank using the second valve driver 57 for controlling the fuel injection control timing. Since the circuit configuration of the first valve driver 57 is the same as the circuit configuration of the first valve driver 56, the description thereof is omitted.

The second control IC 53 drives and controls the second booster circuit 55 and the second valve drivers 58 and 59. The second booster circuit 55 boosts the power source voltage VB based on the boost control signal input from the second control IC 53, and uses the second booster voltage Vboost2 higher than the power source voltage VB as a boost power source for supplying the boost voltage to the second valve drivers 58 and 59.

Figure 5:
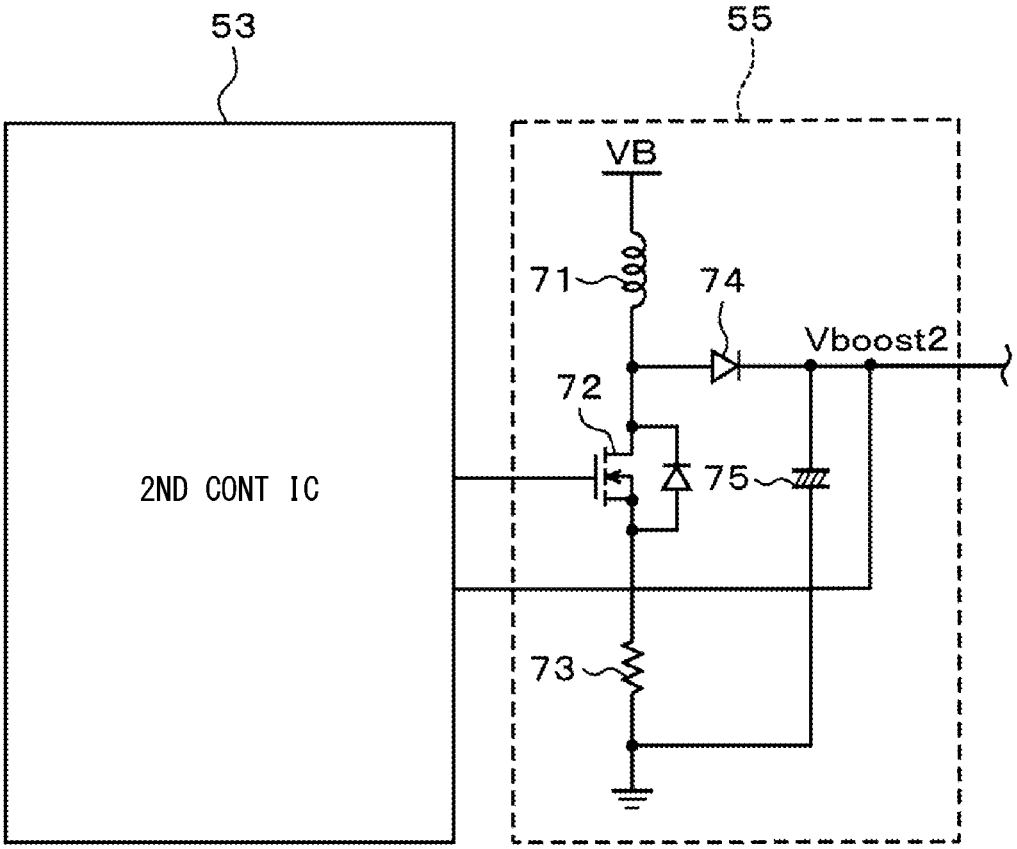
FIG. 5 is a circuit diagram of a booster circuit.

As shown in FIG. 5, the second booster circuit 55 includes a coil 71, an n-channel MOSFET 72, a resistor 73, a diode 74, and a charging capacitor 75. At a position between a supply terminal of the power source voltage VB and a ground, the coil 71, a portion between a drain and a source of the n-channel MOSFET 72, and the resistor 73 are connected in series. A diode 74 is connected in the forward direction from a common connection point of the coil 71 and the drain of the MOSFET 72 to an output node of a second boost voltage Vboost2, and the charging capacitor 75 is connected to a position between the output node and the ground.

Therefore, when the second control IC 53 controls the ON/OFF of the MOSFET 72, the energy accumulated in the coil 71 can be gradually accumulated in (i.e., transferred to) the charging capacitor 75 while an electric current flows in the coil 71. Thereby, the charging capacitor 75 can be charged with storing the second boost voltage Vboost2 higher than the power source voltage VB.

In the above description, it has been described that the configuration of the first booster circuit 54 is the same as that of the second booster circuit 55. However, a full charge voltage value of the first boost voltage Vboost1 of the first booster circuit 54 and a full charge voltage value of the second boost voltage Vboost2 of the second booster circuit 55 may be the same or may be different from each other.

Figure 6:
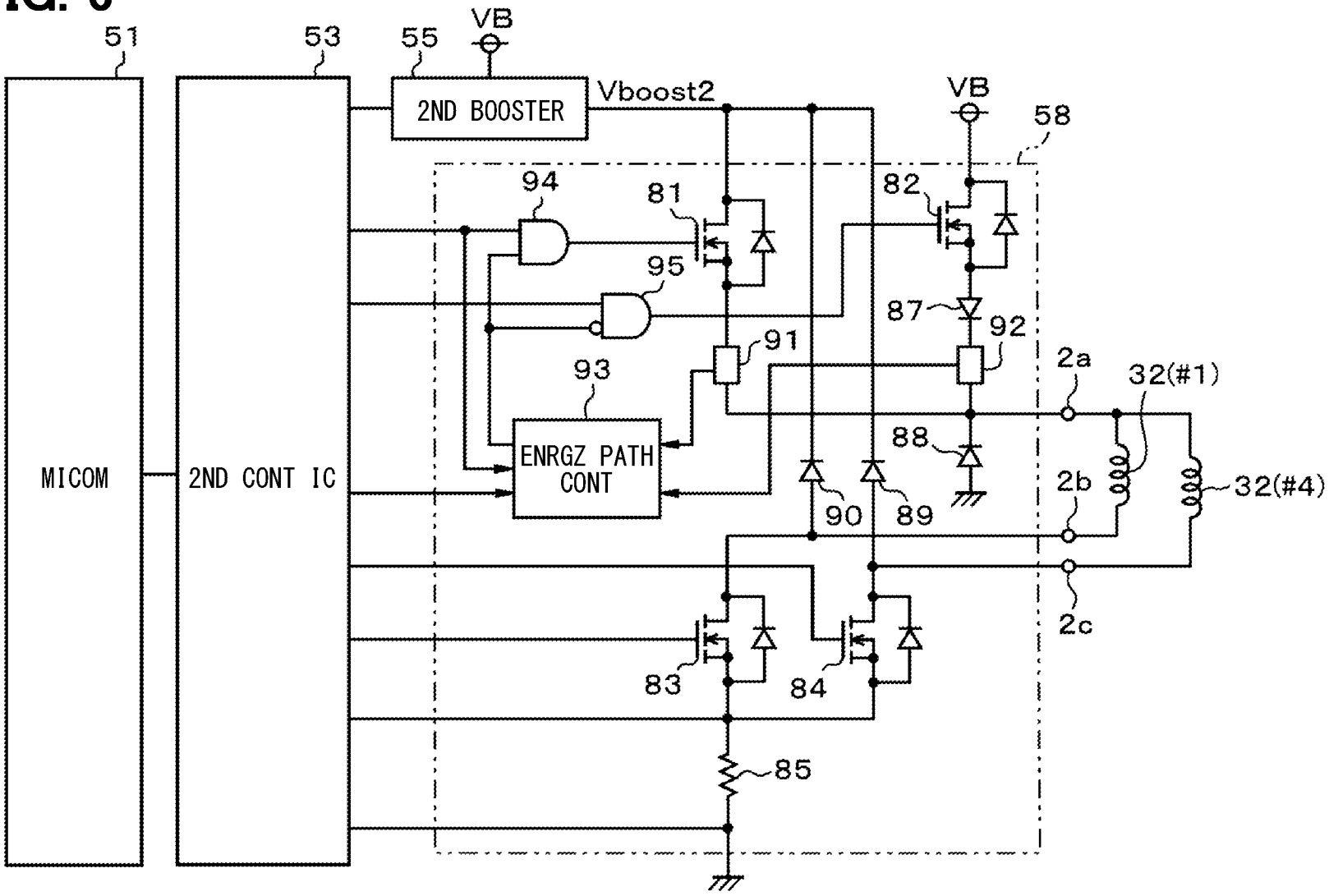
FIG. 6 is a circuit diagram of a valve driver.

As shown in FIG. 6, the second valve driver 58 includes, as its main components, a discharge switch 81, a constant current switch 82, and selection switches 83 and 84, and further includes a combination of a current detection resistor 85 and diodes 87 to 90. The discharge switch 81 and the selection switches 83 and 84 are each configured by, for example, an n-channel MOSFET transistor. The constant current switch 82 is configured by, for example, an n-channel MOS transistor.

The second valve driver 58 energizes and deenergizes (i.e., supplies and interrupts an electric power to) the second solenoid 32 connected to the output terminals 2*a* to 2*c* of the controller 2 when driving the second valve 30 of the fuel injectors 7 and 10 corresponding to the cylinders #1 and #4 of the first bank. Thus, the second control IC 53 can control the fuel injection rate by driving, i.e., opening and closing, the second valve 30 by applying an electric current to the second solenoid 32 using the second valve driver 58.

The discharge switch 81 is connected as a first switch between the output node of the second boost voltage Vboost2 of the second booster circuit 55 and the plus output terminal 2*a* of the controller 2, and the second boost voltage Vboost2 are nput to an input terminal of the discharge switch 81, which is a drain of a MOSFET. The discharge switch 81 energizes/deenergizes (i.e., turns ON/OFF) a first energization path which connects the second boost voltage Vboost2 of the second booster circuit 55 to the second solenoid 32 in accordance with a control signal given from the second control IC 53 to the control terminal of the discharge switch 81.

A first detection element 91 is provided as a first detector that detects a value that depends on an energization state of the discharge switch 81. The first detection element 91 may be implemented as a temperature sensor (i.e., temperature detector) connected in series to the discharge switch 81, for example. The first detection element 91 is an element that changes a detection value T1 that depends on an integrated value of the electric current flowing through the first energization path. When the integrated value of the energization current increases, a high detection value T1 is output therefrom, and when the energization current decreases thereby decreasing the integrated value, a low detection value T1 is output therefrom. The detection value T1 of the first detection element 91 is given to an energization path controller 93.

At a position between the output node of the power source voltage VB and the plus output terminal 2*a* of the controller 2, a drain-source part of a MOSFET constituting the constant current switch 82 and an anode-cathode part of the diode 87 are connected in series. The constant current switch 82 is configured as a second switch, and turns ON/OFF energization of the second energization path from the power source voltage VB to the second solenoid 32.

The second detection element 92 is provided as a second detector that detects a value that depends on an energization state in which the constant current switch 82 is energized. The second detection element 92 may be implemented as a temperature sensor (i.e., temperature detector) connected in series to the constant current switch 82 and the diode 87, for example. The second detection element 92 is an element that changes a detection value T2 that depends on the integrated value of the electric current flowing in the second energization path. When the integrated value of the energization current increases, a high detection value T2 is output therefrom, and when the energization current decreases thereby decreasing the integrated value, a low detection value T2 is output therefrom. The detection value T2 of the second detection element 92 is given to the energization path controller 93.

The diode 88 is reversely connected to a position between the plus output terminal 2*a* of the controller 2 and the ground. The diodes 87 and 88 are respectively provided for preventing energization (i.e., a flow of electric current) from the positive output terminal 2*a* to a supply terminal of the power source voltage VB and from the positive output terminal 2*a* to the ground. The second solenoid 32 for driving the second valve 30 of the fuel injector 7 is connected to a position between the plus output terminal 2*a* and a first minus output terminal 2*b* of the controller 2.

A diode 90 is connected in the forward direction to a position between the first minus output terminal 2*b* of the controller 2 and the output node of the second boost voltage Vboost2 of the second booster circuit 55. The diode 90 is provided for feedback-charging the accumulated energy based on the electric current flowing through the second solenoid 32 to the charging capacitor 75 of the second booster circuit 55 when receiving an injection instruction OFF.

The second solenoid 32 for driving the second valve 30 of the fuel injector 10 is connected to a position between the plus output terminal 2*a* and a second minus output terminal 2*c* of the controller 2.

A diode 89 is connected in the forward direction to a position between the second minus output terminal 2*c* of the controller 2 and the output node of the second boost voltage Vboost2 of the second booster circuit 55. The diode 89 is provided for feedback-charging the accumulated energy based on the electric current flowing through the second solenoid 32 to the charging capacitor 75 of the second booster circuit 55 when the second control IC 53 receives an injection stop instruction as an injection signal from the microcomputer 51.

At a position between the first minus output terminal 2*b* of the controller 2 and the ground, a drain-source part of the MOSFET constituting the selection switch 83 and the current detection resistor 85 are connected in series. At a position between the second minus output terminal 2*c* of the controller 2 and the ground, a drain-source part of the MOS transistor constituting a selection switch 84 and the current detection resistor 85 are connected in series.

The selection switches 83 and 84 are provided to select one of the fuel injectors 7 and 10 for injecting fuel. The current detection resistor 85 detects a voltage of the electric current flowing through the second solenoid 32 of the fuel injector 7 while the selection switch 83 is turned ON. The detection value is input to the second control IC 53. The current detection resistor 85 detects a voltage of the electric current flowing through the second solenoid 32 of the fuel injector 10 while the selection switch 84 is turned ON. The detection value is input to the second control IC 53.

The second control IC 53 outputs a control signal for an ON/OFF control of the discharge switch 81, the constant current switch 82, and the selection switches 83 and 84 based on the setting value and the injection signal set by the microcomputer 51 and the detected current of the current detection resistor 85. A gate circuit 94 is provided at a position between a first control signal output terminal of the second control IC 53 and a control terminal of the discharge switch 81. The gate circuit 94 may be implemented as, for example, an AND gate. A gate circuit 95 is provided at a position between a second control signal output terminal of the second control IC 53 and a control terminal of the constant current switch 82. The gate circuit 95 may be implemented as an AND gate in which one of two inputs is a reverse input.

In addition, the energization path controller 93 outputs one of two levels, i.e., one of "H" and "L," to the gate circuits 94, 95 based on the detection value T1 of the first detection element 91 serving as the first detector and the detection value T2 of the second detection element 92 serving as the second detector. The gate circuits 94 and 95 validate one of the control signals output from the second control IC 53 to the discharge switch 81 or to the constant current switch 82 according to the output level from the energization path controller 93.

That is, the energization path controller 93 is configured to select one of the two energization paths, i.e., either the first energization path (i.e., may also be designated as a discharge path) for energizing the second solenoid 32 through the discharge switch 81 or the second energization path (i.e., may also be designated as a constant current path) for energizing the second solenoid 32 through the constant current switch 82, based on the detection value T1 of the first detection element 91 and the detection value T2 of the second detection element 92.

Figure 7:
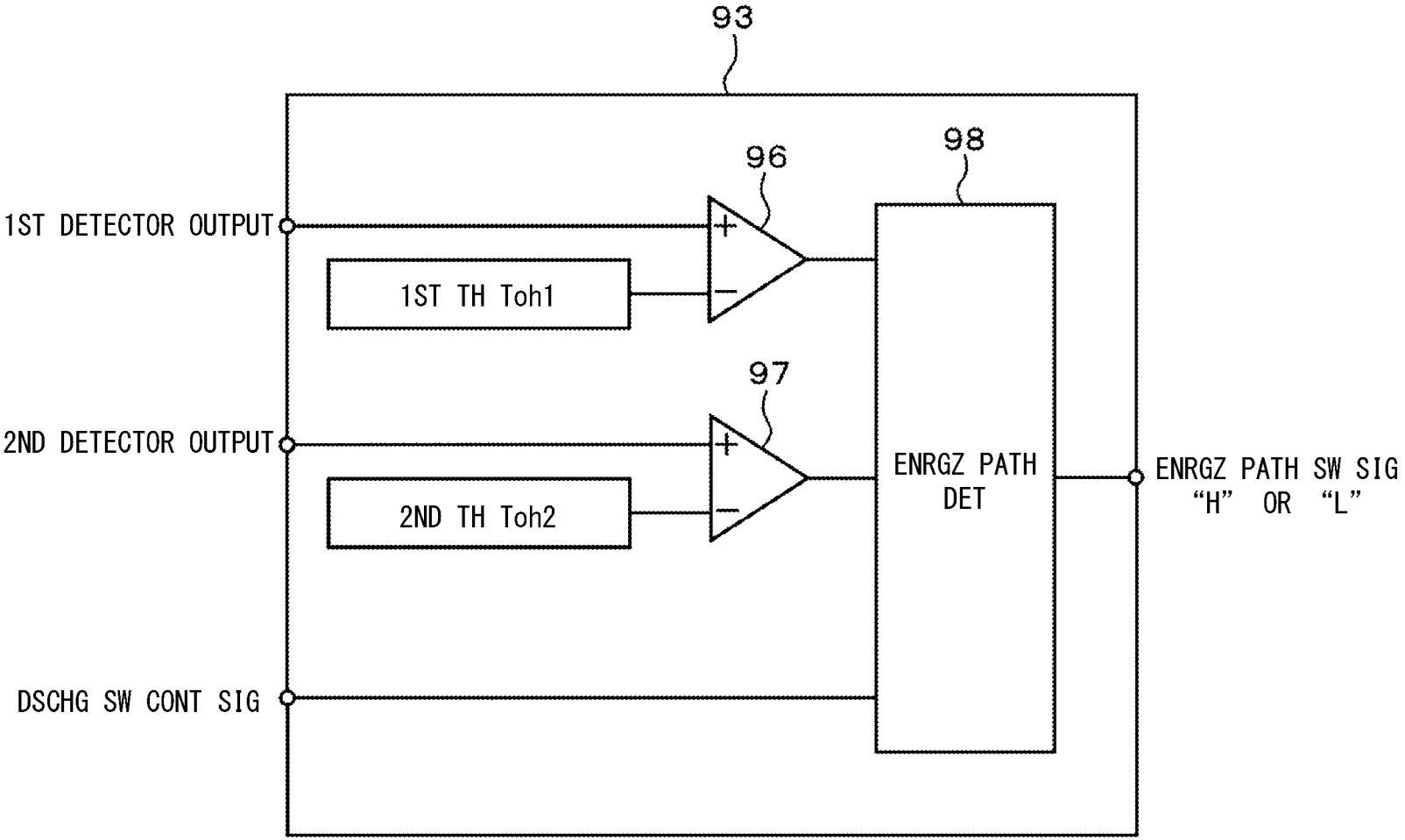
FIG. 7 is a circuit diagram of an energization path controller.

The energization path controller 93 includes a first comparator 96, a second comparator 97, and an energization path determiner 98, as shown in a specific example of FIG. 7. The first comparator 96 compares the detection value T1 of the first detection element 91 with a first threshold value Toh1 for high temperature detection, and outputs a comparison result to the energization path determiner 98. The discharge switch 81 has high temperature, i.e., becomes hot, if energization thereof is continued, and it is desirable to use (i.e., keep using) the discharge switch 81 under a condition that satisfies an allowable range of the device temperature according to the device specifications. The first threshold value Toh1 indicates an electric current value for a continuous energization of the switch 81 while keeping the device temperature within the allowable range.

The second comparator 97 compares the detection value T2 of the second detection element 92 and a second threshold value Toh2 for high temperature detection, and outputs a comparison result to the energization path determiner 98. The constant current switch 82 also becomes hot if it is continuously energized, but it is desirable to keep the device temperature under a condition, i.e., within an allowable range according to the device specifications. The second threshold value Toh2 is a temperature value for a continuous energization of the switch 82 while keeping the device temperature within the allowable range.

The energization path determiner 98 inputs the comparison result of the first comparator 96, the comparison result of the second comparator 97, and the control signal of the discharge switch 81, and selects which one to use, i.e., either the first energization path or the second energization path. Then, after such determination, a determination result is output to the gate circuits 94 and 95 as energization path switch signals.

Normally, the energization path determiner 98 sets the energization path switch signal to "H" at the rise of the control signal of the discharge switch 81 (i.e., at a valve drive start timing), and the energization path switch signal is fixed to (i.e., is set unchanged from) "H" for a high speed valve open operation of the second valve 30 during the discharge control.

The energization path determiner 98 switches the energization path switch signal to "L" according to a comparison result of the first comparator 96, which (i.e., the comparison result) has changed from a previous comparison result when the detection value T1 of the first detection element 91 provided in the first energization path of the discharge switch 81 becomes equal to or higher than the first threshold value Toh1 for high temperature detection.

Conversely, when the detection value T2 of the second detection element 92 provided in the second energization path of the constant current switch 82 becomes equal to or higher than the second threshold value Toh2 for high temperature detection, the energization path determiner 98 switches the energization path switch signal to "H" according to the change of the comparison result of the comparator 97.

Here, in the present embodiment, an operation mode in which the energization path switch signal is switched between "L" and "H" is shown. However, when the detection result of the first detection element 91 is equal to or higher than the first threshold value Toh1 and the detection result of the second detection element 92 is equal to or higher than the second threshold value Toh2, it is assumed that both of the discharge switch 81 in the first energization path and the constant current switch 82 in the second energization path have high temperature. Therefore, the energization path controller 93 may notify the second control IC 53 of the high temperature of both of the discharge switch 81 and the constant current switch 82, and may perform a fail-safe process for stopping the drive of the second valve 30 by the second control IC 53 for circuit protection. In such manner, the second valve driver 58 is configured.

The first valve drivers 56 and 57 may adopt the same configuration as that of the second valve driver 58. However, for realizing a simpler configuration, the first detection element 91, the second detection element 92, and the gate circuits 94, 95, and the energization path controller 93 may be omitted from the configuration of the first valve drivers 56 and 57. In other words, a general configuration may be adopted for the first valve drivers 56 and 57.

Modification Example

Temperature sensors capable of detecting the temperature of the discharge switch 81 and the constant current switch 82 may be disposed in the vicinity of the discharge switch 81 and the constant current switch 82, and the selection of the energization path may be made among the first and the second energization paths based on the temperature detection result of those temperature sensors.

On the other hand, when the second valve driver 59 drives the second valve 30 of the fuel injectors 8 and 9 corresponding to the cylinders #2 and #3 of the second bank, the second valve driver 59 energizes/deenergizes the second solenoid 32 connected to the output terminals 2*a* to 2*c* of the controller 2. Thus, the second control IC 53 controls the fuel injection timing by energizing the second solenoid 32 using the second valve driver 59. Since the circuit configuration of the second valve driver 59 is the same as that of the second valve driver 58, description thereof is omitted.

The pump driver 60 is provided for driving the high-pressure fuel pump 4. Since the configuration of the pump driver 60 conforms to the configuration of the first valve driver 56, description of the circuit configuration thereof is omitted. The first control IC 52 can cut off the current to the drive solenoid 61 of the high-pressure fuel pump 4 using the pump driver 60, and can drive and control the high-pressure fuel pump 4.

<Description of Basic Injection Control Process>

A basic injection control process is described. When the internal combustion engine 11 has four cylinders and four cycles, a single injection or multistage injection such as three times injection, five times injection, etc., are performed in one cycle, which may be defined as within the range of the crank angle 180° CA of the forward and backward crank angle signals with reference to the top dead center TDC. When the controller 2 provides control to inject the fuel from the injection hole 47 of the fuel injectors 7 through 10 into the cylinder of the internal combustion engine 11, the microcomputer 51 outputs an injection start signal corresponding to each of the fuel injectors 7 through 10 to the first control IC 52 and to the second control IC 53.

The case where the microcomputer 51 outputs the injection start signals of injections M and M2 from the fuel injector 7 corresponding to the cylinder #1 to the first control IC 52 and to the second control IC 53, respectively, is described as an example. The first control IC 52 controls interruption of the first orifice 45*a* by energizing the first solenoid 31 and driving the first valve 29. In parallel with the control process of the first control IC 52, the second control IC 53 energizes the second solenoid 32 using the second valve driver 58 to drive the second valve 30, thereby controlling interruption of the second orifice 41 to control the fuel injection rate.

Figure 8:
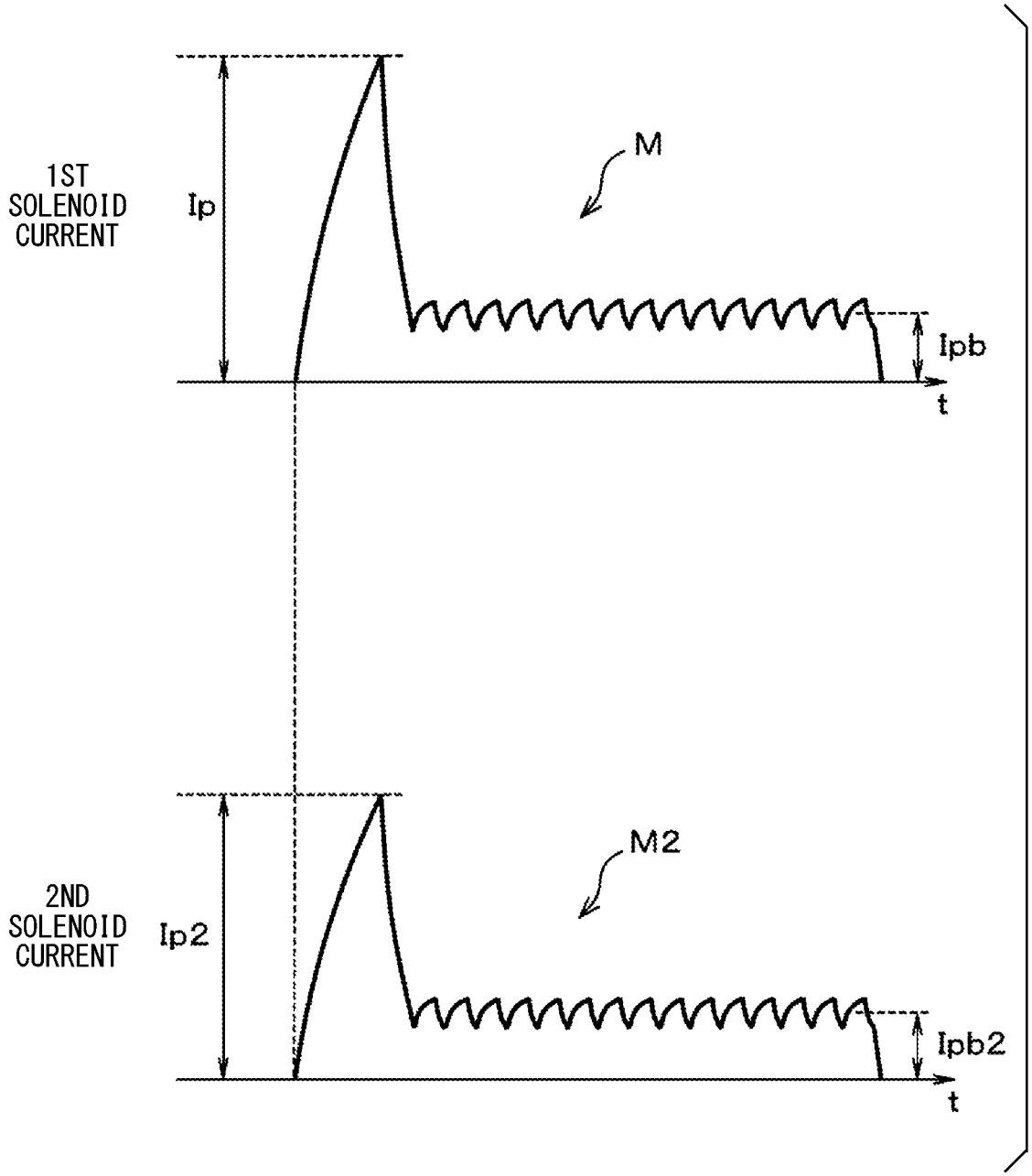
FIG. 8 is a diagram of a valve drive current during a normal injection control.

FIG. 8 shows changes in a valve drive current flowing through the first solenoid 31 and the second solenoid 32. First, the first control IC 52 turns ON the discharge switch 81 while turning ON the selection switch 83.

When the discharge switch 81 and the selection switch 83 are turned ON, the first boost voltage Vboost1 of the charging capacitor 75 of the first booster circuit 54 is applied to the first solenoid 31. Therefore, the valve drive current rises steeply. Thereafter, when the valve drive current reaches the peak current Ip set in the microcomputer 51, the first control IC 52 detects the peak current Ip based on the voltage detected by the current detection resistor 85. Then, as the accumulated energy of the first solenoid 31 returns through the diode 88, the valve drive current decreases and falls down to the constant current Ipb.

When the first control IC 52 detects that the valve drive current has reached the constant current Ipb, the first control IC 52 holds the current flowing through the first solenoid 31 at the constant current Ipb by performing ON/OFF control of the constant current switch 82. The constant current Ipb is set to be lower than the peak current Ip, and is generated using the power source voltage VB without using the first boost voltage Vboost1 of the first booster circuit 54. Thereafter, when the microcomputer 51 outputs an injection stop signal and the first control IC 52 receives the injection stop signal from the microcomputer 51, the first control IC 52 lowers the valve drive current by the turning OFF of the constant current switch 82.

On the other hand, when receiving the injection start signal, the second control IC 53 performs ON/OFF control of the switches 81 to 83. As shown in the energization current of the second solenoid 32 of the injection M2 in FIG. 8, the second control IC 53 controls the valve drive current to a peak current Ip2, and then controls to a predetermined constant current Ipb2 lower than the peak current Ip2. During a normal injection control, the ON/OFF control process of the switches 81 to 83 performed by the second control IC 53 has the same contents as the ON/OFF control process of the switches 81 to 83 performed by the first control IC 52 described above. Therefore, the description thereof is omitted.

The second control IC 53 energizes the second solenoid 32 with the peak current Ip2 using the second boost voltage Vboost2 of the second booster circuit 55 based on ON/OFF control of the discharge switch 81. Further, the second control IC 53 energizes the second solenoid 32 with the constant current Ipb2 by performing ON/OFF control of the constant current switch 82 while keeping the discharge switch 81 turned OFF. Therefore, the constant current Ipb2 is generated using the power source voltage VB without using the second boost voltage Vboost2 of the second booster circuit 55.

Further, the microcomputer 51 sets the current setting values for driving the first valve 29 (i.e., the peak which are different from the current setting values for driving the second valve 30 (i.e., the peak current Ip2, and the constant current Ipb2). In addition, the microcomputer 51 sets an energization time of these current setting values independently for each of those values according to the characteristics of the first valve 29 and the second valve 30.

However, the microcomputer 51 sets the ON/OFF control timing of each of the switches 81 to 83 by the second control IC 53 to be the same as or different from the ON/OFF control timing of each of the switches 81 to 83 by the first control IC 52, for the adjustment of the open/close control timing of the first valve 29 and the second valve 30. As a result, the fuel injection rate can be changed and controlled in accordance with the aforementioned modes. By performing such control, the controller 2 can inject fuel while switching between the high injection rate mode, the low injection rate mode, and the boot injection mode described above.

<Decompression Control>

Figure 9:
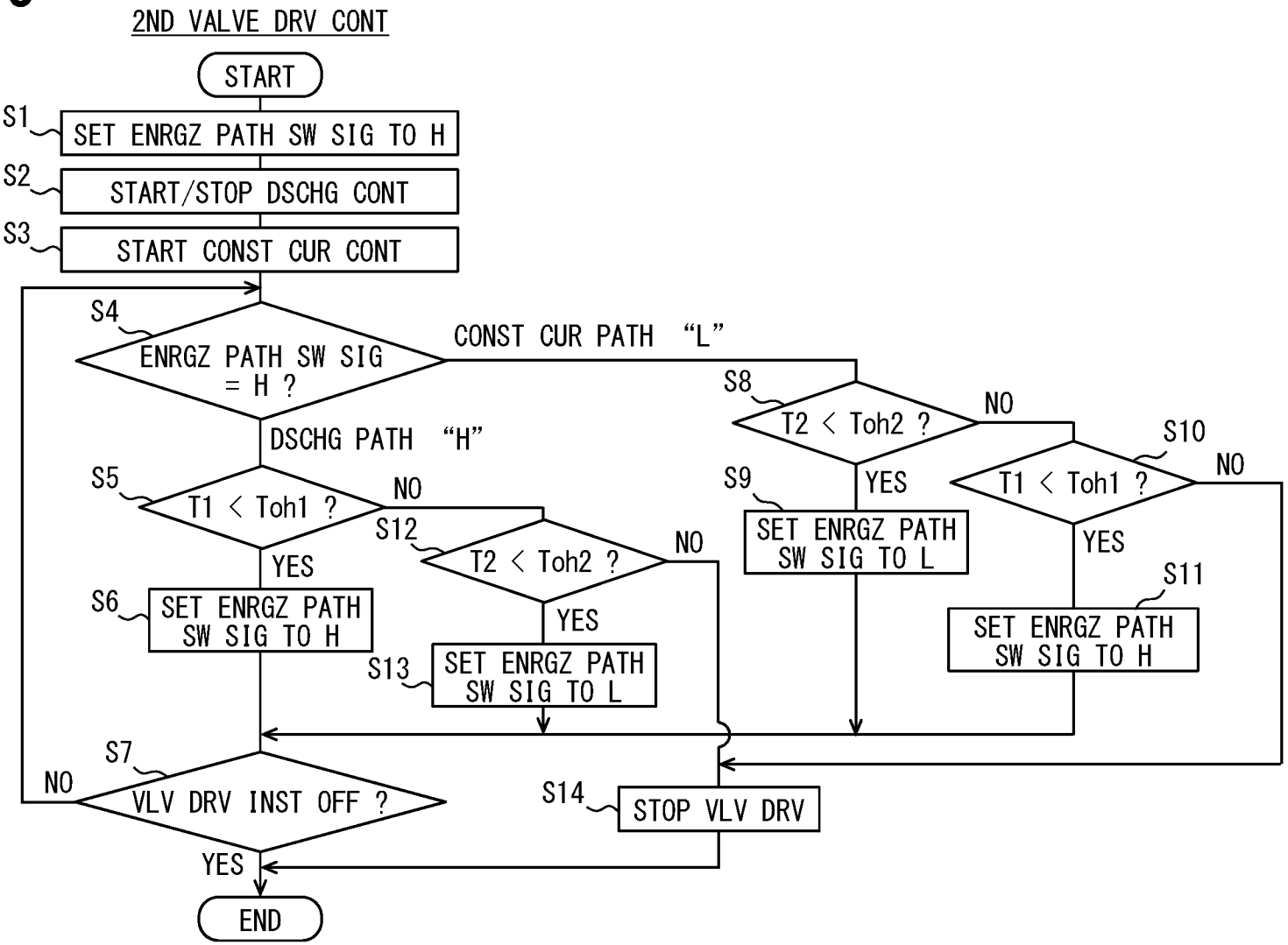
FIG. 9 is a flowchart of a drive control process of a second valve.
Figure 10:
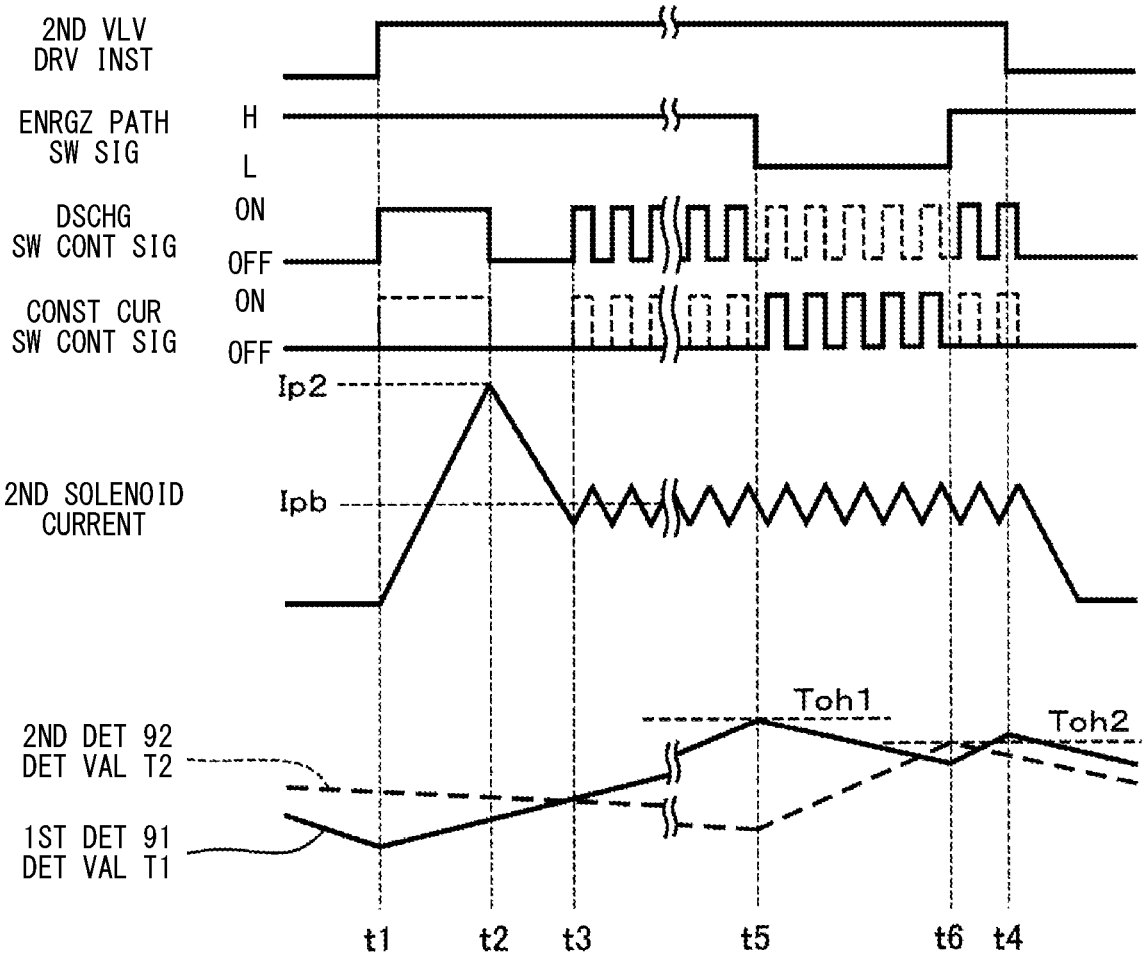
FIG. 10 is a timing chart of (i) an ON/OFF control signal of a first switch and a second switch, and (ii) changes in detection values of a first detector and a second detector.

With reference to FIGS. 9 and 10, the description below explains an operation of a process in which the controller 2 provides control to reduce the internal pressure of the common rail 5.

Normally, the microcomputer 51 confirms an internal pressure state of the common rail 5 by using either the pressure sensor 14 or the built-in pressure sensors 7*a* to 10*a* of the fuel injectors 7 to 10, and when the internal pressure exceeds a pressure upper limit threshold value, it is determined that the pressure is abnormally high. When reducing the internal pressure of the common rail 5, the microcomputer 51 closes the first valve 29 by deenergizing the first solenoid 31 by the first control IC 52 while opening the second valve 30 by energizing the second solenoid 32 by the second control IC 53.

The microcomputer 51 sets an energization condition of the second solenoid 32 that drives the second valve 30 at the time of abnormality, and outputs a depressurization instruction to the second control IC 53 together with the energization condition of the second solenoid 32 as a pressure adjustment instruction signal. At such time, since the energization control is continuously performed on the second solenoid 32 for most of one cycle, the second solenoid 32 is continuously controlled (i.e., energized) for a long continuous time compared to single injection or compared to individual injections in the multistage injection of the normal injection control process. The second control IC 53 opens a target second valve 30 by energizing a target second solenoid 32 using the second valve driver 58 or 59, thereby reducing the internal pressure of the common rail 5 in the rail decompression mode described above.

More specifically, when the second control IC 53 energizes the second solenoid 32 using the second valve driver 58, the energization control is performed on the second solenoid 32 while changing the energization path switch signal as shown in FIG. 9.

The second control IC 53 sets the energization path switch signal to "H" in the initial state of S1 to enable the first energization path of the discharge switch 81, and controls the discharge switch 81 by turning ON and OFF the discharge switch 81 in S2. Execute. See t1 to t3 in FIG. 10. During a period from t1 to t3, since the energization path switch signal is set to "H," the constant current switch 82 is held as being turned OFF.

Then, the second control IC 53 starts a constant current control in S3. At such time, the second control IC 53 controls to maintain the constant current Ipb by repeating the ON/OFF control of the discharge switch 81. See t3 to t4 in FIG. 10.

During such a period, the second control IC 53 determines whether the energization path switch signal is "H" or "L" in S4, and if it is determined that the current path is the discharge path "H," it is determined whether or not the detection value T1 of the detection element 91 is less than the first threshold value Toh1, and if it is (i.e., less than the first threshold value Toh1), the energization path switch signal is held and set to "H"0 (i.e., kept unchanged from "H") in S6.

Since the second control IC 53 switches the energization path to the discharge path, the discharge switch 81 is repeatedly turned ON and OFF, whereby the temperature of the discharge switch 81 gradually rises and the detection value T1 of the first detection element 91 gradually increases. On the other hand, since the constant current switch 82 is not repeatedly turned ON and OFF, the temperature of the constant current switch 82 gradually falls and the detection value T2 of the second detection element 92 also gradually decreases. See t1 to t5 in FIG. 10.

Thereafter, when it is determined that the detection value T1 of the first detection element 91 becomes equal to or greater than the first threshold value Toh1, and based on a condition that the detection value T2 of the second detection element 92 is less than the second threshold value Toh2 (YES in S12), the second control IC 53 switches and sets the energization path switch signal to "L" in S13. See t5 in FIG. 10.

The timing for switching the energization path switch signal to "L" may preferably be a timing in a period during which (i) the energization of the second solenoid 32 through the first energization path via the discharge switch 81 is turned OFF, and (ii) the energization of the second solenoid 32 though the second energization path via the constant current switch 82 is turned OFF. See t5 in FIG. 10. This is because switching of the energization path switch signal to "L" while both of the discharge switch 81 and the constant current switch 82 are OFF can suppress fluctuations in the behavior of the valve drive current.

Further, when the second control IC 53 determines in S4 that the energization path switch signal is the constant current path "L," the second control IC 53 determines whether the detection value T2 of the second detection element 92 is less than the second threshold value Toh2 in S8, and, if it is (i.e., less than the second threshold value Toh2), then holds and sets the energization path switch signal to "L" (i.e., signal kept unchanged from "L") in S9.

Since the second control IC 53 switches the energization path to the constant current path, the constant current switch 82 is repeatedly turned ON and OFF, thereby the temperature of the constant current switch 82 gradually rises and the detection value T2 of the second detection element 92 also gradually increases. On the other hand, since the discharge switch 81 is not repeatedly turned ON and OFF, the temperature of the discharge switch 81 gradually falls and the detection value T1 of the first detection element 91 also gradually decreases. See t5 to t6 in FIG. 10.

Thereafter, when the detection value T2 of the second detection element 92 becomes equal to or greater than the second threshold value Toh2, based on a condition that the detection value T1 of the first detection element 91 is less than the first threshold value Toh1 (YES in S10), the second control IC 53 switches and sets the energization path switch signal to "H" in S11. See t6 in FIG. 10.

The timing of switching the energization path switch signal to "H" may preferably be a timing in a period during which (i) the energization of the second solenoid 32 through the first energization path via the discharge switch 81 is turned OFF, and (ii) the energization of the second solenoid 32 though the second energization path via the constant current switch 82 is turned OFF. See t6 in FIG. 10. This is because switching of the energization path switch signal to "L" while both of the discharge switch 81 and the constant current switch 82 are OFF can suppress fluctuations in the behavior of the valve drive current.

The second control IC 53 repeats the second valve drive control related to S4 to S6, S12 to S13, S8 to S9, and S10 to S11 until the second valve drive instruction is turned OFF (YES in S7).

In such manner, the constant current Ipb can be continuously applied to the second solenoid 32 without raising the temperature of the discharge path (i.e., the discharge switch 81) and the constant current path (i.e., the constant current switch 82, the diode 87) more than necessary, the second valve 30 can be kept open.

Note that, after the above control, when the microcomputer 51 determines that the target pressure has been reached by detecting the signals from the pressure sensor 14 and the built-in pressure sensors 7*a* to 10*a*, the microcomputer 51 stops energization of the target second solenoid 32.

As described above, according to the present embodiment, the energization path controller 93 energizes the second solenoid 32 by switching to either one of the first energization path via the discharge switch 81 or the second energization path via the constant current switch 82 based on the detection value T1 of the first detection element 91 and the detection value T2 of the second detection element 92, heat stress is reducible for the second energization path (i.e., for the constant current switch 82) when energizing the second solenoid 32 from the first energization path, and reducible for the first energization path (i.e., for the discharge switch 81) when energizing the second solenoid 32 from the second energization path. As a result, the second solenoid 32 can be energized without applying heat stress to the discharge switch 81 and to the constant current switch 82 as much as possible, and the operation reliability of the elements of the discharge switch 81 and the constant current switch 82 can be improved.

The configuration of the energization path controller 93 is described as an operation that, only when the internal pressure of the common rail 5 is reduced, the switching between the first and second energization paths is activated or performed (i.e., the first energization path—discharge path via the discharge switch 81 or the second energization path—constant current path via the constant current switch 82) based on the detection value T1 of the first detection element 91 and the detection value T2 of the second detection element 92, the switching between the first and second energization path may also be performed based on the detection value T1 of the first detection element 91 and the detection value T2 of the second detection element 92 during the time of performing the normal injection control.

Conventionally, the common rail 5 is provided with a pressure reduction valve. However, if the fuel can be discharged from the low-pressure chamber 36 of the fuel injectors 7 to 10 as disclosed in the present embodiment, it is not necessary to provide the common rail 5 with a pressure reduction valve. In addition to the configuration of the present embodiment, the common rail 5 may have a pressure reduction valve provided therein.

Second Embodiment

Figure 11:
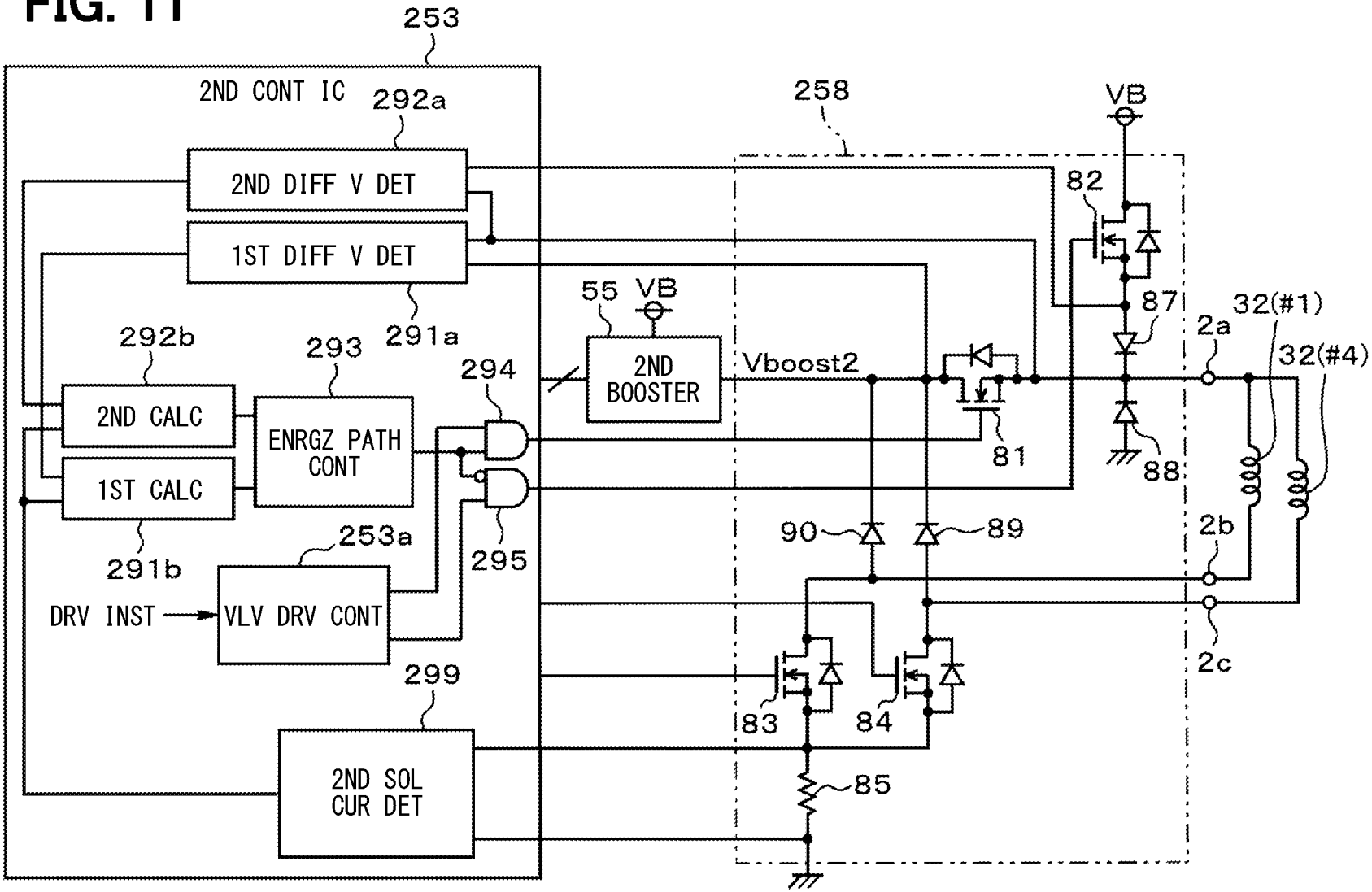
FIG. 11 is an electrical configuration diagram of a second controller and a second valve driver in a second embodiment.

FIG. 11 is an explanatory diagram of the second embodiment. In the second embodiment, a second control IC 253 includes a first differential voltage detector 291*a*, a second differential voltage detector 292*a*, a first calculator 291*b*, a second calculator 292*b*, an energization path controller 293, gate circuits 294, 295, a valve drive controller 253*a*, and a second solenoid current detector 299 are provided to drive a second valve driver 258.

The first differential voltage detector 291*a* serving as the first detector and the first voltage detector detects the voltage across the energization terminals (for example, a drain) of the discharge switch 81 as a value that depends on the energization state of the discharge switch 81. The second differential voltage detector 292*a* serving as the second detector and the second voltage detector detects the voltage across the two terminals of the diode 87 for the constant current control, that is, detects a voltage between the anode and the cathode of the diode 87, as a value that depends on the energization state of the diode 87. The second solenoid current detector 299 detects the electric current flowing through the second solenoid 32 by detecting the voltage between the terminals of the current detection resistor 85.

The first calculator 291*b* calculates a first power loss based on the detection voltage of the first differential voltage detector 291*a* and the detection current of the second solenoid current detector 299. The first calculator 291*b* can calculate the first power loss to obtain the power consumption of the discharge switch 81, and the first calculator 291*b* can calculate and estimate the temperature of the discharge switch 81.

The second calculator 292*b* calculates a second power loss based on the detected voltage of the second differential voltage detector 292*a* and the detected current of the second solenoid current detector 299. The second calculator 292*b* can calculate the second power loss to obtain the power consumption of the diode 87, and the second calculator 292*b* can calculate and estimate the temperature of the diode 87.

The energization path controller 293 is configured to output "H" or "L" to the gate circuits 294 and 295 based on the level of the loss obtained by comparing the first power loss and the second power loss, and to switch the energization path indicated by the control signal that is output by the valve drive controller 253*a*.

At such time, when the gate circuits 294 and 295 receive "H" from the energization path controller 293, the valve drive controller 253*a* outputs a control signal to the discharge switch 81, and the first energization path through the discharge switch 81 performs the energization of the second solenoid 32. When the gate circuits 294 and 295 receive "L" from the energization path controller 293, the valve drive controller 253*a* outputs a control signal to the constant current switch 82, and the second energization path through the constant current switch 82 performs the energization of the second solenoid 32. Therefore, the energization of the second solenoid 32 is performable through the energization path having a low estimated temperature, thereby achieving the effects similar to those of the first embodiment.

According to the second embodiment, the externally-attached first and second detection elements 91 and 92 are not required as compared with the first embodiment. Since the first detection element 91 does not intervene (i.e., is not disposed) in the first energization path and the second detection element 92 does not intervene (i.e., is not disposed) in the second energization path, the deteriorated influence of the injector energization current is eliminated, and the accuracy of the injector drive current can be improved. Moreover, cost and the substrate size of the controller 2 can be reduced.

In the above-described configuration, the detection target element in the second energization path via the constant current switch 82 has been described as the diode 87. However, a configuration for detecting the voltage between the drain and the source of the constant current switch 82 (MOSFET) may also be adopted. When the amount of heat generated by the diode 87 is large, the voltage between the anode and the cathode of the diode 87 may preferably be detected.

Third Embodiment

Figure 12:
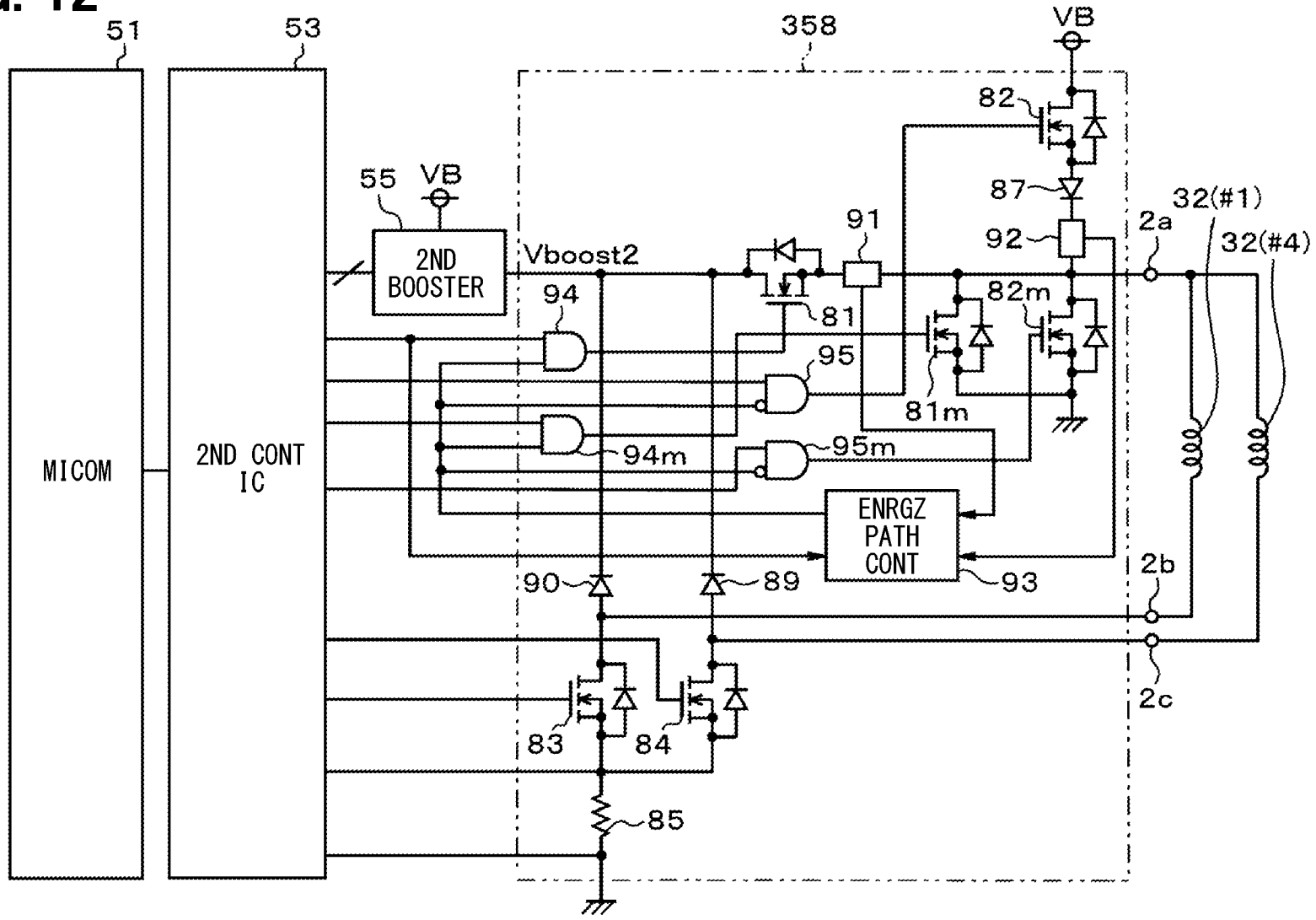
FIG. 12 is an electrical configuration diagram of the second valve driver in a third embodiment.

FIG. 12 shows an explanatory diagram of the third embodiment. The same parts as those in the first embodiment are designated by the same reference numerals and description thereof is omitted, and different parts are described below.

A second valve driver 358 includes a first recirculation switch 81*m*, a second recirculation switch 82*m*, and gate circuits 94*m* and 95*m* in addition to the configuration of the second valve driver 58 described in the above embodiments.

The first recirculation switch 81*m* is composed of, for example, an n-channel MOS transistor, and has a drain connected to the output terminal 2*a* and a source connected to the ground. The second recirculation switch 82*m* is also composed of, for example, an n-channel MOSFET transistor, and has a drain connected to the output terminal 2*a* and a source connected to the ground.

The gate circuit 94*m* is provided at a position between a third control signal output terminal of the second control IC 53 and the control terminal (i.e., gate) of the first recirculation switch 81*m*. The gate circuit 94*m* is constituted by, for example, an AND gate. The gate circuit 95*m* is provided at a position between a fourth control signal output terminal of the second control IC 53 and the control terminal (i.e., gate) of the second recirculation switch 82*m*. The gate circuit 95*m* is constituted by, for example, an AND gate in which one two inputs is a reverse input.

The energization path controller 93 sets the level of either "H" or "L" to the gate circuits 94, 94*m* and 95, 95*m* based on the detection value T1 of the first detection element 91 and the detection value T2 of the second detection element 92.

The gate circuits 94 and 95 validate one of the control signals output from the second control IC 53 to the discharge switch 81 or to the constant current switch 82 according to the output level from the energization path controller 93.

The gate circuits 94*m* and 95*m* validate one of the control signals output from the second control IC 53 to the first recirculation switch 81*m* or the second recirculation switch 82*m* according to the level of output from the energization path controller 93.

The second control IC 53 outputs a control signal that changes complementarily between a first control signal output to the discharge switch 81 via the gate circuit 94 and a third control signal output to the first recirculation switch 81*m* via the gate circuit 94*m*.

The second control IC 53 outputs a control signal that changes complementarily between a second control signal output to the constant current switch 82 via the gate circuit 95 and a fourth control signal output to the second recirculation switch 82*m* via the gate circuit 95*m*.

At such time, the energization path controller 93 outputs "H" to the gate circuits 94, 95, 94*m*, and 95*m*, thereby executing the switching operation of the discharge switch 81 and the first recirculation switch 81*m* by the second control IC 53. Even when the turning OFF is performed after the turning ON of the discharge switch 81 by the second control IC 53 is, the drive current continues to flow through the second solenoid 32. At such time, the second control IC 53 turns ON the first recirculation switch 81*m* to recirculate the electric current through the switch 81*m*. While the energization path controller 93 continues to output "H," the second control IC 53 turns ON the discharge switch 81 and the first recirculation switch 81*m* in an alternating manner, thereby the electric current flowing through the discharge switch 81 is recirculated via the first recirculation switch 81*m*.

On the contrary, the energization path controller 93 outputs "L" to the gate circuits 94, 95, 94*m*, and 95*m*, thereby validating the switching operation of the constant current switch 82 and the second recirculation switch 82*m* by the second control IC 53. Even when the turning OFF is performed after the turning OFF of the constant current switch 82 by the second control IC 53, the drive current continues to flow through the second solenoid 32. At such time, the second control IC 53 turns ON the second recirculation switch 82*m* to recirculate the electric current through the second recirculation switch 82*m*. While the energization path controller 93 continues to output "L," the second control IC 53 turns ON the constant current switch 82 and the second recirculation switch 82*m* in a alternating manner, thereby the electric current flowing through the constant current switch 82 is recirculated through the second recirculation switch 82*m*.

According to the present embodiment, heat distribution among the two recirculation paths (i.e., among the first recirculation switch 81*m* and the second recirculation switch 82*m* provided on the recirculation path) is performable, by (i) having the first recirculation switch 81*m* and the second recirculation switch 82*m* provided on the recirculation path, and (ii) energizing the second solenoid 32 (a) from the second booster circuit 55 and (b) from the power source voltage VB (i.e., from the battery power source) respectively having separate recirculation paths, for the prevention of damage by too much amount of heat.

Other Embodiments

The present disclosure is not limited to the above-described embodiments, and various modifications can be made without departing from the scope of the present disclosure. For example, the following modifications or expansions are possible.

In the embodiments described above, the fuel is returned from the fuel injectors 7 to 10 to the fuel tank 12 through the low-pressure pipe 38. However, the common rail 5 may be provided with a pressure reduction valve. When the common rail 5 is provided with a pressure reduction valve, the pressure may be reduced from the pressure reduction valve or from the fuel injectors 7 to 10.

When the common rail 5 is not provided with a pressure reduction valve, the pressure may be reduced from the fuel injectors 7 to 10. The pressure sensor 14 may be provided as the built-in pressure sensors 7*a* to 10*a* of the fuel injectors 7 to 10, or the pressure sensor 14 may be provided as the one in the common rail 5.

The first control IC 52 and the second control IC 53 may be configured in one integrated circuit, may be configured in two separate integrated circuits, or may be integrated in the microcomputer 51 as a controller. The first control chamber 43 and the second control chamber 49 may be configured as an integral, one chamber.

Although the switches 81 to 84 are described as n-channel MOS transistors in the above-described embodiments, those switches may also be implemented as various types of transistors and switching elements. Although one second orifice 41*a* is provided in the second passage 41 in the above-described embodiments, a plurality of passages connecting the low-pressure chamber 36 and the first control chamber 43 may be provided, and/or the second orifice 41*a* may be provided in each of the plurality of passages. That is, at least one second orifice 41*a* may suffice.

In the above-described embodiments, since the internal combustion engine 11 includes four cylinders, those cylinders corresponding to fuel injectors 7 to 10 are grouped into two sets, i.e., two banks, as cylinders #1 and #4 group and cylinders #2 and #3 group. However, the configuration is not limited to such grouping. Even for a 6 cylinder engine, the present disclosure is applicable.

When performing multistage injection, the second solenoid 32 may be energized through the discharge switch 81 in the preceding injection stage(s), and the second solenoid 32 may be energized through the constant current switch 82 in the subsequent injection stage(s). In such a case, the drive element of the second solenoid 32 can be changed for each of the multiple injection stages, and damage caused by heat to the heat generation elements can be prevented.

The configurations of the embodiments can be applied in combination as appropriate. A part of the above-described embodiments may be dispensed of as long as the problem identified in the background is resolvable. In addition, various modifications of the present disclosure may be considered as encompassed in the present disclosure, as long as such modifications pertain to the gist of the present disclosure.

Although the present disclosure is described based on the above embodiments, the present disclosure is not limited to the disclosure of those embodiments and the structure thereof. The present disclosure is intended to cover various modification examples and equivalents thereof. In addition, various modes/combinations, one or more elements added/subtracted thereto/therefrom, may also be considered as the present disclosure and understood as the technical thought thereof.

What is claimed is:

1. A fuel injection controller for controlling injection of fuel from a common rail where fuel is accumulated to an internal combustion engine using fuel injectors, the fuel injectors each including a first solenoid, a first valve, a second solenoid, and a second valve, the fuel injection controller comprising:

a first controller configured to control a fuel injection timing by driving the first valve by energizing the first solenoid during a normal injection control;

a second controller configured to control a fuel injection rate by driving the second valve by energizing the second solenoid during the normal injection control;

a first switch configured to turn ON/OFF energization of a first energization path from a boost power source of a booster circuit to the second solenoid when the second controller energizes the second solenoid;

a first detector configured to detect an electric current value that depends on an energization state of the first switch;

a second switch configured to turn ON/OFF energization of a second energization path from a battery power source that outputs a voltage lower than the boost power source to the second solenoid when the second controller energizes the second solenoid;

a second detector configured to detect a value that depends on an energization state of the second switch; and an energization path controller configured to energize the second solenoid by switching to either of the first energization path or the second energization path based on detection results of the first detector and the second detector.

2. The fuel injection controller of claim 1, wherein:

when reducing an internal pressure of the common rail, the first controller closes the first valve by deenergizing the first solenoid and the second controller opens the second valve by energizing the second solenoid, and the energization path controller activates a function of switching to the first energization path or to the second energization path based on the detection results of the first detector and the second detector only when the internal pressure of the common rail is reduced.

3. The fuel injection controller of claim 1, wherein the first detector includes a first detection element configured to change a first detection value that depends on an integrated value of an electric current flowing through the first energization path, the second detector includes a second detection element configured to change a second detection value that depends on an integrated value of an electric current flowing through the second energization path, and the energization path controller energizes the second solenoid by switching to either the first energization path or the second energization path based on the first detection value of the first detection element and the second detection value of the second detection element.

4. The fuel injection controller of claim 1, wherein while energization of the first energization path to the second solenoid is turned OFF by the first switch and energization of the second energization path to the second solenoid is turned OFF by the second switch, the energization path controller switches to either the first energization path or to the second energization path.

5. The fuel injection controller of claim 1, wherein the first detector includes a first voltage detector configured to detect a voltage across the first switch, the second detector includes a second voltage detector configured to detect a voltage across the second switch, a current detector configured to detect an electric current flowing through the second solenoid, a first calculator configured to calculate a first power loss based on a detection voltage of the first voltage detector and a detection current of the current detector, a second calculator configured to calculate a second power loss based on the detection voltage of the second voltage detector and the detection current of the current detector, and the energization path controller switches to either of the first energization path or the second energization path based on a level of power loss obtained by comparing the first power loss and the second power loss.

6. The fuel injection controller of claim 1, further comprising:

a first recirculation switch included in a first recirculation path for recirculating the electric current that flows through the second solenoid when the first switch is turned from ON to OFF, and a second recirculation switch included in a second recirculation path for recirculating the electric current that flows through the second solenoid when the second switch is turned from ON to OFF.

* * * * *